US012514307B2

(12) United States Patent
Carlander et al.

(10) Patent No.: US 12,514,307 B2
(45) Date of Patent: Jan. 6, 2026

(54) WEARABLE PROTECTION DEVICE

(71) Applicant: Autoliv Development AB, Vargarda (SE)

(72) Inventors: Magnus Carlander, Fristad (SE); Leif Nilsson, Gothenburg (SE); Patrik Ivarsson, Alingsås (SE); Henrik Balague, Falköping (SE); Jack Johansson, Landvetter (SE); Magnus Larsson, Vara (SE); Fredrik Lundemo, Vargarda (SE)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 18/709,739

(22) PCT Filed: Oct. 24, 2022

(86) PCT No.: PCT/EP2022/079536
§ 371 (c)(1),
(2) Date: May 13, 2024

(87) PCT Pub. No.: WO2023/083591
PCT Pub. Date: May 19, 2023

(65) Prior Publication Data

US 2024/0423303 A1 Dec. 26, 2024

(30) Foreign Application Priority Data

Nov. 15, 2021 (DE) ..... 10 2021 129 765.6

(51) Int. Cl.
*A41D 13/018* (2006.01)
*A41D 13/05* (2006.01)

(52) U.S. Cl.
CPC ..... *A41D 13/018* (2013.01); *A41D 13/0506* (2013.01)

(58) Field of Classification Search
CPC .. A41D 13/018; A41D 13/0506; A41D 13/05; A41D 13/0155; B60R 21/16
See application file for complete search history.

(56) References Cited

U.S. PATENT DOCUMENTS 5,500,952 A * 3/1996 Keyes ..... A41D 13/018 2/908
2021/0261079 A1* 8/2021 Hagg ..... B60R 21/231
(Continued)

FOREIGN PATENT DOCUMENTS

CN 109008022 A * 12/2018 ..... A41D 13/0525
CN 112 056 648 A 12/2020
(Continued)

*Primary Examiner* — Khoa D Huynh
*Assistant Examiner* — Erick I Lopez
(74) *Attorney, Agent, or Firm* — Dickinson Wright PLLC

(57) ABSTRACT

The present disclosure relates to protection devices. In particular, the present disclosure relates to protection devices that can be worn on the human body. Further in particular, the present disclosure relates to wearable protection devices that inflate to prevent injury of the human body in case of an accident, e.g., a fall accident. Accordingly, there is provided a wearable protection device for protection of at least a body part of a wearer, comprising an inflatable element arranged adjacent to a body part to be protected, wherein the inflatable element is inflatable from a first, substantially uninflated condition to a second, substantially inflated condition, by application of a releasable source of a gas to the inflatable element, for at least partially filling of the inflatable element with said gas.

14 Claims, 15 Drawing Sheets

(56) References Cited

U.S. PATENT DOCUMENTS

| | | | | |
|---|---|---|---|---|
| 2022/0095708 | A1* | 3/2022 | Kawamura | A41D 13/018 |
| 2022/0095711 | A1* | 3/2022 | Yanagisawa | A41D 13/018 |

FOREIGN PATENT DOCUMENTS

| | | | |
|---|---|---|---|
| CN | 112 089 121 | A | 12/2020 |
| KR | 102 136 171 | B1 | 7/2020 |

* cited by examiner

WEARABLE PROTECTION DEVICE

TECHNICAL FIELD

The present disclosure relates to protection devices. In particular, the present disclosure relates to protection devices that can be worn on the human body. Further in particular, the present disclosure relates to wearable protection devices that inflate to prevent injury of the human body in case of an accident, e.g., a fall accident.

BACKGROUND

Inflatable protection devices are well known in the automotive industry. For a long time, inflatable elements, also known as airbags, have been provided in the interior of vehicles to protect occupants in the case of accidents. Such inflatable elements are deployed, i.e., inflated, in the event of an imminent or ongoing vehicle crash, to cushion the impact of a vehicle occupant on elements of the car like the steering wheel or the dashboard. Over time, additional inflatable elements were distributed throughout the car cabin to provide further protection in case of uncommon crash angles. E.g., side airbags, window airbags as well as airbags for rear seat passengers are common practice nowadays. Some vehicles even comprise inflatable elements arranged at the exterior of the vehicle in order to protect people involved in a vehicle crash but outside of the vehicle in the event of a crash scenario.

Newer personal protection devices are intended to provide specific protection of dedicated body parts by arranging the inflatable protection devices in the vicinity of a certain body part to be protected. By wearing an inflatable protection device at a defined position on the body, the inflatable protection device may be inflated in the event of an imminent or ongoing accident to provide a cushioning effect for that certain body part. E.g., inflatable protection devices are known that are worn like a regular belt and comprise inflatable elements that are arranged to deploy upon detection of a fall incident, to mitigate the fall by providing a cushioning effect, to reduce impact forces acting on the body of the wearer. In other words, such inflatable protection devices, e.g., intended to provide protection for the hip area of its wearer, detect that the person wearing the protection device is about to fall and subsequently initiates deployment of the inflatable elements, i.e. inflating inflatable elements. The inflatable elements are arranged in the vicinity of the body part to be protected so that the inflatable element is expected to be situated between the body of the wearer and the impacting object, e.g. the floor, a wall, or another arbitrary object at the time of impact to protect the body part.

Inflatable elements when transitioning from an essentially uninflated condition to an inflated condition regularly change their shape due to the filling of the interior of the inflatable element with a gas. Such a change in shape regularly comprises that at least one dimension of the inflatable element increases, i.e., gets larger, while another dimension of the inflatable elements decreases, i.e., gets smaller. Such a change in shape or dimension may mean that the inflatable element actually moves away from the body parts to be protected or at least is positioned some distance from the body part. In other words, there is a tendency for inflatable elements to flare out from its intended protection position due to forces provided by inflating the inflatable element. At the same time, by increasing one dimension during inflation which regularly is in the radial direction, thus pointing away from the body of the wearer, while decreasing in another dimension which regularly is in the circumferential direction of the body of the wearer, inflatable elements have the tendency to shift their alignment relative to the body part to be protected. Further, a good and tight fit of the wearable protection device relative to the body of the wearer is required to assure protection from accidents. At the same time, wearing a wearable protection device for an extended period of time may be uncomfortable in case the tight fit is maintained throughout the full time of wearing.

At the same time, while the physical dimensions of wearers may differ significantly between individual wearers, the physical dimensions of the respective body part to be protected may not change in the same order of magnitude. In other words, to accommodate a wide range of physical dimensions of possible wearers, it may not be required to change the physical dimensions of the protection device in the same manner. This may result in a comparatively small number of different sizes of wearable protection devices being able to accommodate a comparatively large number of different physical dimensions of wearers. In consequence, while a wearable protection device may not change with regard to his physical dimensions, it may still be required to position the wearable protection device appropriately aligned and thereby adjacent to the body part to be protected.

Thus, there may be a need to assure that the inflatable element remains suitably arranged relative to the body parts to be protected when deploying, i.e., inflating, the personal protection device.

Further, there may be a need to provide an attachment for a wearable protection device to a body of a wearer such that the position of the protection device relative to the body of the wearer can be easily set without changing the dimensions of the wearable protection device or its elements.

SUMMARY

At least one such need may be met by the subject-matter of the independent claims. Preferred embodiments are provided in the dependent claims and are explained in detail in the following description.

The present invention relates to wearable protection devices to prevent injury of the human body in case of an accident.

According to a first aspect of the disclosure, there is provided a wearable protection device for protection of at least a body part of a wearer, comprising an inflatable element arranged adjacent to a body part to be protected, wherein the inflatable element is inflatable from a first, substantially uninflated condition to a second, substantially inflated condition, by application of a releasable source of a gas to the inflatable element, for at least partially filling of the inflatable element with said gas, wherein the inflatable element, when being inflated to the second condition, assumes a predetermined three-dimensional shape, wherein the inflatable element comprises a first extension in a first direction and a second extension in a second direction, wherein the first direction and the second directions are non-parallel to one another, wherein one of the first extension and the second extension in the first condition is larger than in the second condition, and wherein the other one of the first extension and the second extension in the first condition is smaller than in the second condition, so that when transitioning from the first condition to the second condition, the inflatable element increases in dimension in one extension while the inflatable element decreases in dimension in the other extension, wherein the wearable protection device is connectable to an attachment device for attaching the wearable protection device to the wearer, and wherein the wearable protection device is adapted to be at least partially slidable relative to the attachment device, so that when one of the first extension and the second extension becomes smaller while inflating the inflatable element, the wearable protection device slides along the attachment device while maintaining being connected to the attachment device and being arranged adjacent to a body part to be protected.

According to an embodiment of the present disclosure, the wearable protection device may be connectable to the attachment device by a plurality of loop elements, wherein the loop elements may be adapted for accommodating the attachment device and are arranged for sliding along a length of the attachment device.

Loop elements may provide preferred means of attachment of the wearable protection device to the attachment device. The attachment device may be fed through the loop elements and slide along the same, so that a user of the wearable protection device may easily mount the personal protection device by sliding the attachment device onto the wearable protection device. Likewise, while the wearable protection device stays substantially unchanged with regards to its physical dimensions, different attachment devices for accommodating different physical dimensions of wearers may be used and the wearable protection device mounted thereon, so to accommodate different physical sizes of wearers. Further, by using elements allowing the wearable protection device sliding on the attachment device, the position of the wearable protection device on the body of a wearer may be adjusted. Thereby, the relative position of the wearable protection device with regard to the body part to be protected may be adjusted so that the inflatable element may be arranged adjacent to the bodyguard to be protected. E.g., a wearer may mount the wearable protection device to their body while the slidability provided by the loop elements may allow the relative positioning of the inflatable element and/or the wearable protection device on the attachment device, thereby allowing the aligning of the inflatable element and/or the wearable protection device relative to the body part to be protected.

According to a further embodiment of the present disclosure, the inflatable element and at least one loop element of the plurality of loop elements may be integrally formed, thereby forming an opening for accommodating the attachment device, in particularly wherein the inflatable element and at least one loop element of the plurality of loop elements may be integrally formed of a one-piece woven fabric.

According to a further embodiment of the present disclosure, the inflatable element and at least one of the plurality of loop elements may be in contact at two contact regions, wherein the inflatable element and the at least one of the plurality of loop elements may be integrally formed at a first contact region of the two contact regions, and wherein the inflatable element and the at least one of the plurality of loop elements may be connected but not integrally formed at a second contact region of the two contact regions, thereby forming an opening for accommodating the attachment device.

By integrally forming of a loop element and the inflatable element, a preferred strong connection between the elements and the guide elements may be achieved. Being integrally formed may in particular be understood as such an integral connection between the part forming the inflatable element and the part forming the loop. In other words, part of the inflatable element may transition into part of the loop element. In this case, the loop element may have an open end that may be brought back into contact with the inflatable element at a desired location where the loop element and the inflatable element may in turn be connected to one another so to form the loop. This connection in turn may not be integral connection but may be a stitching or welding, thereby creating a connecting seam between the loop element and the inflatable element.

Alternatively, the inflatable element and a loop element may be fully integrally formed in that the inflatable element and the loop elements may form an integral weave throughout, effectively integrally connecting the loop element and the inflatable element at both ends of the loop. To achieve such a integrally connection, the loop element and the inflatable element may be integrally formed, e.g. may be made of a one-piece woven fabric, so that the loop element and the inflatable element are made of essentially uninterrupted threads, so that no external attachment like welding or a stitching is required. Forming the loop element and the inflatable element integrally in this manner provides a very strong connection between the loop element and the inflatable element. Further, this allows the provision of a loop element attached to the inflatable element at areas where a stitching or welding may not be performed. E.g., in areas where the inflatable element is actually inflating, it may not be possible to stitch or weld the loop element to the inflatable element without impairing the inflatability.

According to a further embodiment of the present disclosure, the inflatable element may comprise inflatable regions and uninflatable regions, and wherein at least one of the plurality of loop elements is attached to two uninflatable regions of the inflatable element, thereby forming an opening for accommodating the attachment device.

By connecting a loop element to uninflatable regions of the inflatable elements, the connection may be provided by stitching or welding, thus a connection method which would otherwise impair the inflatability of the inflatable element. Further, by attaching a loop element to uninflatable regions, the position of the loop element may remain substantially unchanged in the inflated condition and the uninflated condition of the inflatable element. In other words, the geometry of the loop element relative to the attachment device may not change or may change to a lesser extent when the loop element is attached to two uninflatable regions of the inflatable element compared to being attached to only one uninflated region or no uninflated region of the inflatable element. E.g., by changing a relative local dimension of the inflatable element when being inflated, the geometry of the loop element may be negatively affected.

According to a further embodiment of the present disclosure, the inflatable element may comprise a one-piece woven fabric and wherein the uninflatable regions may be regions where the one-piece woven fabric is integrally woven.

In order to be inflatable, the inflatable element requires the provisions of a fillable volume provided between at least two layers of fabric, e.g., a front layer and a back layer. These layers may be integrally formed or woven in regions where normally seams would be provided for connecting the layers. Instead of using such seams like stitching or welding, the layers of fabric of the inflatable element are integrally woven so that thread from the two layers are interview, resulting in substantially a single fabric. By using one-piece weaving, the fillable volumes of the inflatable elements may be arranged freely throughout the fabric, and the geometrical shape of the inflatable element may be determined freely. It is further not required to provide separate layers of fabric that there then connected together by stitching or welding, but inflatable element may be produced by a continuous weaving process in a single production step. Building fillable volumes of the inflatable element by one-piece weaving provides a stronger fabric connection in the area of the uninflatable regions, thereby increasing the tensile strength and thereby the load capacity of the inflatable element.

According to a further embodiment of the present disclosure, the loop elements may comprise a lengthwise extension, and wherein the lengthwise extension of a first subset of loop elements and the lengthwise extension of a second subset of loop elements may be non-parallel.

When an inflatable element is inflated, it regularly changes shape and dimension due to the changing of its volume in defined regions. Thus, by changing the volume, i.e., inflating the inflatable element, the inflatable element/the wearable protection device is deformed when being inflated. Such a deformation also impacts the relative alignment of the loop elements of the wearable protection device. By providing multiple loop elements that are not all oriented parallel to one another, the impact that such a deformation has on the relative alignment of the loop elements to one another and to the attachment device may be reduced. E.g., in case the increase in volume and thus the deformation results in a relative rotation of individual elements relative to one another the attachment device may get jammed in the loop elements so that the slidable of the wearable protection device on the attachment device may be negatively impacted in other words, due to the inflation, the loop elements may twist or turn, thereby catching on the attachment device, increasing the friction relative to the attachment device so that a substantially easy sliding of the wearable protection device on the attachment device may not be provided any more. By angling a subgroup of loop elements relative to a further subgroup of loop elements, the overall impact may be equalised. Here, while some loop elements may increase in friction relative to the attachment device, other loop elements may decrease in friction, so that the overall friction for sliding is maintained.

Alternatively, the respective orientation of a loop elements may be adapted to the expected deformation of the inflatable element when being inflated. I.e., individual loop elements may be oriented such that, knowing the occurring deformation, the deformation does not substantially change the orientation and/or alignment of the loop element relative to the attachment device. Thereby, again, the overall friction for sliding is maintained so that the slidability of the wearable protection device relative to the attachment device is not negatively impacted.

According to a further embodiment of the present disclosure, the inflatable element at a first end may remain substantially fixed relative to the attachment device, when the inflatable element slides relative to the attachment device when being inflated, while the wearable protection device at a second end opposite of the first end slides relative to the attachment device and towards the first end, wherein the wearable protection device may be shortened in length when being inflated, and wherein the inflatable element may be asymmetrical with regard to a point arranged centrally between the first end and the second end, in particular wherein the part of the inflatable element between the second end and the centrally arranged point may be larger than the part of the inflatable element between the first end and the centrally arranged point.

According to a further embodiment of the present disclosure, the attachment device may be a belt.

By providing a fixed position at a first end, a repeating alignment of the inflatable element with regard to the body part to be protected may be facilitated. In other words, the inflatable element/the wearable protection device may be accommodated to the physical dimension of a wearer so that the inflatable element lines with the body parts to be protected while remaining at a fixed position on the attachment device. When the wearable protection device is removed from the body of the wearer, e.g., during sleep, and reattach in the morning, the wearable protection device may easily be reattached so that the inflatable element again aligns with the body parts to be protected, without the need to re-align the relative position of the inflatable element and the body part to be protected. Further, by providing the inflatable element/the wearable protection device at a defined position on the attachment device avoids the shift of the inflatable element/the wearable text protection device on the attachment device. This in turn avoids the accidental misalignment by accidental relocation of the inflatable element relative to the body part to be protected while wearing the wearable protection device. E.g., when the wearable protection device is worn throughout the day for an extended period of time, having a wearable protection device that is freely movable on the attachment device may result in a relative misalignment of the wearable protection device and the attachment device. In other words, while the attachment device may remain in a defined position relative to the body of the wearer, a relative shift of the wearable protection device on the attachment device may result in a misalignment of the inflatable element and the body part to be protected.

For example, in case the attachment device is a belt, a wearer could easily realign the belt relative to themselves throughout the day, e.g., by from to time to time realigning a dedicated landmark of the attachment device, e.g., a buckle, with the body of the wearer. In case the inflatable element/the wearable protection device is relative to the attachment device, the realignment of the attachment device relative to the body of the wearer may not assure a proper (re) alignment of the inflatable element/the wearable protection device relative to the body part to be protected. Only when the inflatable element, the variable protection device is affixed to the attachment device, sets accidental misalignment may be avoided.

Fixing the inflatable element to the attachment device at one end only still allows that part of the inflatable element slides relative to the attachment device in case the dimensions of the inflatable element change. E.g., when inflating the inflatable element, a first dimension may be reduced while a second dimension may be extended. In other words, a length of the inflatable elements may be shortened due to the inflation so that at least part of the inflatable element needs to shift along the circumference of the attachment device. By fixing one end only of the inflatable element to the attachment device, the remainder of the inflatable element may still slide along the attachment device, in particular in the direction of the fixed end. Here, the physical dimensions of the inflatable element may be chosen such that the inflatable elements, even in the inflated stayed with changed physical dimension remains adjacent to the body part to be protected. In other words, the inflatable element may be dimensioned such that it aligns with and accommodates the body part to be protected when in the inflated state. This in turn may result in a slight misalignment of the inflatable element when in the uninflated state. However, since the inflatable element/the wearable protection device essentially does not provide a protecting function when uninflated, such misalignment in the uninflated state is neglectable. One option to compensate shortening of extension of the inflatable element when being inflated compared to its uninflated state is to provide a sufficiently large inflatable element so that the inflatable element remains adjacent to the body part to be protected when being inflated.

According to a further embodiment of the present disclosure, the attachment device may be adjustable so to accommodate a plurality of wearer sizes, in particular wherein adjusting the size of the attachment device does not change the alignment of the wearable protection device relative to the attachment device.

In other words, the attachment device has a region to which the wearable protection device is attached to, while having a different region, substantially free of the wearable protection device or at least not fixedly connected to the wearable protection device that allows the adjustment of the attachment device to a wearer size. In the example of a belt, the wearable protection device could be arranged at a first region of the belt, whereas the belt can be adjusted in size so to accommodate the circumference of the wearer. E.g., the wearable protection device could be arranged at the belt in a substantially central region between the belt buckle and the open end, while by adjusting the belt relative to the open end, the size of the belt may be adjusted. Preferably, the adjustment is performed symmetrically at both ends of the attachment device, in particular symmetrically with regards to an arranged or fixed wearable protection device, so that the alignment of the wearable protection device/the inflatable element with the body part to be protected is not changed by the setting of the size.

Alternatively, in particular in case where the wearable protection device is not embodied as a symmetrical protection device, i.e. not protecting symmetrical body parts, the wearer could align the wearable protection device with the (single) body part to be protected and adjust the attachment device for a good fit relative to the body of the wearer. E.g., in case of a wearable protection device exemplary protecting a joint like a knee joint or elbow joint, the wearer could align the wearable protection device with the joint and closing or fastening of the attachment device so that the wearable protection device remains adjacent to the joint. This example, a symmetrical alignment of, e.g. the belt buckle or another means for fastening the attachment device, to the wearable protection device may not be required, since the wearable protection device is not embodied as a symmetrical protection device, e.g. protecting both hip joints, but rather only a single protection device, protecting a single joint.

According to a further embodiment of the present disclosure, the wearable protection device may comprise a one-piece woven fabric with woven in tethers for providing the defined three-dimensional shape when in the substantially inflated condition.

According to a further embodiment of the present disclosure, the defined three-dimensional shape is adapted to the body part to be protected.

Woven in tethers provide a method for imposing a defined three-dimensional shape onto an inflatable element when it is in the inflated condition. When the inflatable element is in an underinflated, i.e., the first condition, woven in tethers within the inflatable chamber of the inflatable element are substantially without tension, so that the sides of the inflatable element may rest close together. In this condition, the inflatable element may be freely deformable, e.g. may be folded or rolled to be accommodated in a smaller space than unfolded or rolled out. As soon as the inflatable element is substantially inflated, thus the sides of the inflatable element are pushed outwardly by the pressure provided by the gas within the inflatable element, the tethers become tensioned and thereby allow imposing a defined three-dimensional shape onto the inflatable element. By providing such tethers at appropriate positions, and thereby connecting the two sides of the inflatable element appropriately by the tethers, the three-dimensional shape of the inflatable element may be adapted to an anatomical shape of the body part to be protected. A preferred method for integrating such tethers into the inflatable element is by providing woven in tethers, which are incorporated into a potentially one-piece woven inflatable element at the time of leaving the inflatable element. Thereby, a subsequent introduction of tethers into the inflatable element, e.g., by stitching such tethers into the inflatable element, may be avoided. This provides a preferred airtightness of the inflatable element with the woven in tethers as compared to separately and subsequently attached tethers by stitching.

According to a further embodiment of the present disclosure, the wearable protection device may comprise at least two inflatable elements arranged symmetrically to a body axis of the wearer, in particularly symmetrical with regard to the longitudinal axis of the wearer.

Since the human body is generally symmetrical with regard to its longitudinal axis, providing a wearable protection device that comprises a plurality of inflatable elements may be favourable. The inflatable elements may be mirrored with regard to one another. Further, an easier manufacture of the wearable protection device may be result from providing multiple smaller inflatable elements, each adapted to a specific body part to be protected or rather part of said body part. E.g., with regard to a hip protection device, the wearable protection device may comprise two separate inflatable elements, one inflatable element arranged adjacent to the left and right hip area, respectively. This also allows an easier adaptation of a wearable protection device to a plurality of wearer sizes, as only the relative alignment of one inflatable element relative to one of the hips needs to be adjusted while the general distance between the inflatable elements and thus the size of the hip circumference is of secondary importance.

Further, it is conceivable that only the inflatable element of the side where an impact is expected is deployed while the other inflatable element remains substantially on inflated. Thus, after a protection event, only one of the plurality of inflatable elements needs to be replaced. This requires separate gas generating elements for each individual inflatable element. Alternatively, even in case of separate inflatable elements, such may be deployed by a single gas generating element, e.g., arranged in the symmetrical centre of exemplarily two inflatable elements.

According to a further embodiment of the present disclosure, the wearable protection device may be a hip protection device, in particular to be worn around the waist of the wearer and protecting the body part in the event of a fall incident.

In this scenario, the wearable protection device may generally have the shape of a belt or may be attached to a common belt and may have undeployed inflatable elements arranged symmetrically with regard to the rear hip region of the wearer. Fall events, especially when the wearer is often an advanced age, often result in severe hip injury, possibly requiring advanced surgery like replacing hip joints with artificial hip joints in case of a femoral neck fracture. Since recovery from such an injury is long and tedious, fall accidents should be avoided or at least mitigated like when wearing a wearable protection device according to the present disclosure.

According to a further embodiment of the present disclosure, the wearable protection device, when being inflated, may deploy in a direction substantially perpendicular to the lengthwise extension of the attachment device, in particular deploying around the body of the wearer so to accommodate the body part to be protected in the inflatable element for mitigating a fall impact.

When the wearable protection device is attached to the body of the wearer in a substantially circumferential manner, it may be preferable that the inflatable elements inflates in a direction generally perpendicular to the circumferential direction so to inflate without any external obstruction. In such a case, the inflatable element may be rolled up or folded and may thus extend in the lengthwise extension of the body part to be protected by unrolling or unfolding. Such an arrangement would provide a small footprint of the wearable protection device when attached to the body of the wearer while providing sufficient protection in the case of an accident by not only to inflate to provide a cushioning effect but also to increase in size and thus surface area, preferably to substantially encompass the body part to be protected. E.g., with regards to a hip protection device, the wearable protection device could be worn like a belt worn above the hips while extending from the area above the hips until below the buttock region for providing substantially complete protection of the hips. In case of exemplarily a knee or elbow protection device, the wearable protection device could be worn proximal from the joint to be protected and may extend in the inflated condition over the joint to be protected until the distal region of the joint.

The present disclosure describes the particular application scenario of a hip protection device to protect the hip region of the wearer by the wearable protection device. However, it will be appreciated that the concept described herein may equally apply to wearable protection devices protecting different body parts like the back region, the neck region, the torso, arms and legs, is separate. In such a particular scenario, the wearable protection device may be embodied as a wearable vest.

Briefly summarising and using different terminology, the present disclosure provides an airbag as an inflatable element configured to be inflated by a source of gas, the airbag being formed from first and second layers of fabric arranged in superimposition to define an inflatable chamber or region between the layers for the receipt of inflating gas; each layer of fabric having a structure comprising at least one yarn, and the two layers being interconnected by a plurality of tether yarns extending between the layers within the inflatable chamber, wherein at least some of said tether yarns are implicated in the structure of said layers within a first group of connection regions or seams, comprising a plurality of first connection regions within which the tether yarns are implicated in the structure of the first layer, and a plurality of second connection regions or seams within which the tether yarns are implicated in the structure of the second layer, and at least some of said tether yarns are implicated in the structure of said layers at a second group of connection regions comprising a plurality of first connection regions within which the tether yarns are implicated in the structure of the first layer, and a plurality of second connection regions within which the tether yarns are implicated in the structure of the second layer, wherein within each said group of connection regions: i) each said first connection region is wider in a length-direction of the tether yarns than each said second connection region, and ii) said second connection regions are offset relative to said first connection regions such that said second connection regions do not oppose any said first connection regions across the inflatable chamber, and wherein said first and second connection regions within each group are elongate and extend generally parallel to one another and across respective layers of the airbag, the connection regions of the first group being non-parallel to the connection regions of the second group, the tether yarns serving to induce a first curvature to the airbag via the first group of connection regions, and to induce a second curvature to the airbag via the second group of connection regions, when the inflatable chamber is inflated.

Further, at least one of said groups of connection regions comprises a first set of said first and second connection regions, and a second set of first and second connection regions, each first connection region of said first set extending collinearly relative to a respective first connection region of said second set, and each second connection region of the first set extending collinearly relative to a respective second connection of the second set, and wherein the first and second sets of connection regions are separated from one another by a flexure seam interconnecting the first and second layers of fabric.

BRIEF DESCRIPTION OF THE DRAWINGS

The present invention will now be described with reference to the accompanying drawings, in which:

FIGS. 5*a* to 5*c* show a further exemplary embodiment of a wearable protection device according to the present disclosure and its application.

DETAILED DESCRIPTION

Figure 1:
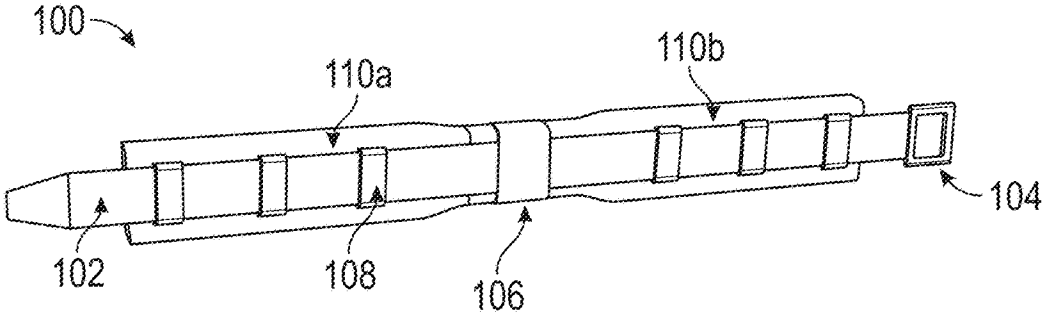
FIG. 1 shows an exemplary embodiment of a wearable protection device according to the present disclosure.

Now referring to FIG. 1, where an exemplary embodiment of a wearable protection device according to the present disclosure is shown.

In FIG. 1, a wearable protection device 100 is shown, exemplarily embodied as a protection device to be worn with an attachment device, e.g., a belt 102. The belt 102 may be attached to the hip region of a wearer and by closing the belt 102, i.e., feeding the belt 102 through the buckle 104 and fastening the buckle 104, the size of the wearable protection device 100 around the waist of the wearer may be adjusted so to allow comfortable wearing of the wearable protection device 100. The wearable protection device 100 comprises two inflatable elements 110*a*, 110*b*, arranged around a central portion 106 of the wearable protection device 100. In other words, the inflatable elements 110*a*, 110*b* are arranged symmetrically with regard to the central portion 106. The belt 102 may be integrally formed with the wearable protection device 100 or, as depicted in FIG. 1, may be separate from belt 102. It is conceivable that belt 102 is comparable to a common household belt to which the wearable protection device is attached to, e.g., by loop elements 108. The attachment device 102 may in particular comprise adjustability, at one end, either near the buckle 104 or an open end opposite the buckle 104, or at both ends. In other words, the adjustability may be provided on both sides of the inflatable element or on one side of the inflatable element. Further, the attachment device 102 may have preferred friction or sliding properties, in particular in the region of the loop elements to allow for an easy sliding of the wearable protection device 100 on the attachment device 102.

Preferably, the wearable protection device 100 is fixable relative to the belt 102 so to avoid unintended movement of the wearable protection device 100 relative to the belt 102. Such an unintended movement may reposition the wearable protection device 100 relative to the body of the wearer, resulting in a misalignment of the wearable protection device 100, in particular its inflatable elements 110*a*, 110*b* relative to the body of the wearer and thus the body parts to be protected by the wearable protection device.

In FIG. 1, the individual inflatable elements 110*a*, 110*b* are exemplarily depicted as folded so to provide a compact outer shape when in an undeployed, uninflated condition. Not specifically depicted in FIG. 1 is at least one gas generating element adapted for releasing the generated gas into the interior of the inflatable elements 110*a*, 110*b*, in order to inflate the inflatable elements 110*a*, 110*b* by the application of the generated gas. The one or multiple gas generating elements may be arranged in the interior of the wearable protection device 100 in the general area of the central portion 106. The provision of the gas generating element in central portion 106 allows the provision of the gas to both inflatable elements 110*a*, 110*b* substantially simultaneously, thereby assuring a substantially simultaneous inflation. Alternatively, two gas generating elements may be provided, each in turn connected to one individual inflatable element 110*a*, 110*b*. This may allow the independent deployment, i.e., inflation of the inflatable elements 110*a*, 110*b*. In other words, the provision of two independent gas generating elements may allow that only one of a plurality of inflatable elements is inflated at a given time. E.g., only that inflatable element may be inflated which in a current accident scenario would provide the protection for the body part to be protected. In other words, only that inflatable element which cushions the fall of the wearer could be inflated, thereby retaining further inflatable elements uninflated, so that for a particular accident scenario, unused inflatable elements need not be exchanged.

Figure 2:
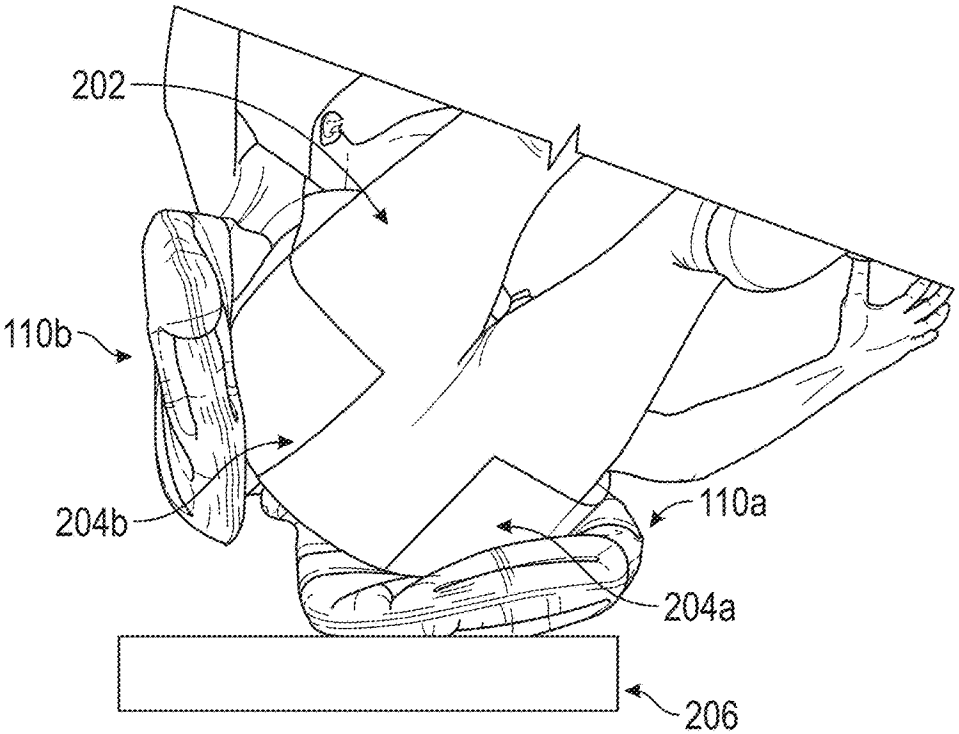
FIG. 2 shows an exemplary embodiment of an application of a wearable protection device arranged at a wearer according to the present disclosure.

Now referring to FIG. 2, where an exemplary embodiment of an application of a wearable protection device arranged at a wearer according to the present disclosure is shown.

In FIG. 2, the two inflatable elements 110*a*, 110*b* are depicted in their in inflated state. The wearable protection device 100 is arranged around the hip of a wearer 202. The exemplary wearable protection device 100 depicted in the FIG. 1 and two is a hip protection device protecting the hip regions of the wearer from a fall impact. In other words, the body parts to be protected 104*a,b* are generally the buttock regions of the wearer 202 where the hip joints are situated. In a fall scenario, the wearer 202 could fall sideways and impact an object 206, e.g., the floor or a street, in the area of their hip joint region, thereby resulting in severe hip injury. Especially in case where the bone structure is already in a progressed state of dissolution or regression, such a fall impact may result in a broken hip joint, requiring extensive surgery like an artificial hip replacement.

The inflatable elements 110*a*, 110*b* of the wearable protection device 100 by arranging them adjacent to the body parts to be protected 204*a,b*, protect the body of the wearer from such fall impact and thus injury. As can be seen in FIG. 2, the inflatable elements 110*a*, 110*b* comprise a three dimensional shape in that they extends downwardly and bend inwardly in the deployed condition, so to wrap around the buttock region of the wearer 202. Such a three dimensional shape for accommodating the anatomical characteristics of the wearer keep the inflatable elements 110*a*, 110*b* close to the body part to be protected so to avoid that one of the inflatable elements 110*a*, 110*b*, in the moment of impact, is so far away from the body of the wearer 202 that an optimal protection may not be provided anymore. In a worst-case scenario, the inflatable elements 110*a*, 110*b* would flare out to an extent that the body parts to be protected is essentially exposed and thus not protected anymore from the fall impact. By providing an according three dimensional shape, the flaring out of the inflatable elements 110*a*, 110*b* may be avoided.

The wearer 202 in FIG. 2 is in the process of a fall event in the moments where the wearer impacts with their left hip onto object 206, e.g., the floor. Inflatable element 110*a* is arranged between the object 206 and the body part to be protected 204*a*, i.e., the left hip. The inflatable element 110*a* has successfully inflated, is arranged adjacent to the body parts to be protected 204*a* and thereby mitigates the fall impact. Inflatable element 110*a* essentially acts as an airbag for the wearer 202 to dampen the fall onto the ground.

Figure 3B:
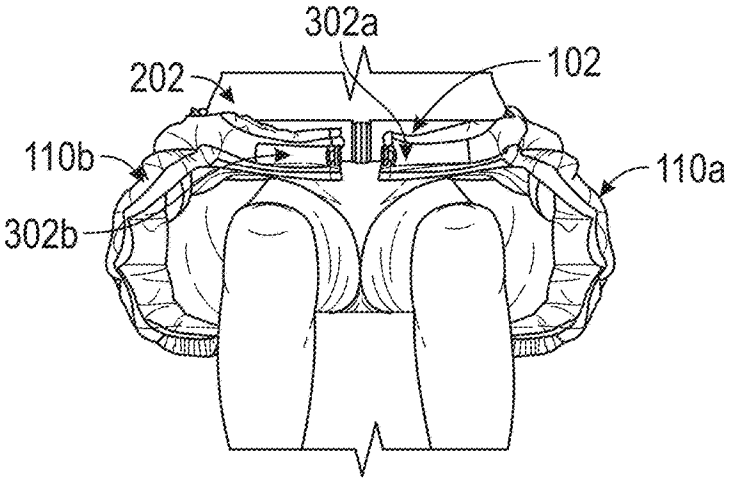
FIGS. 3*a* to 3*c* show a further exemplary embodiment of a wearable protection device according to the present disclosure and its application.
Figure 3A:
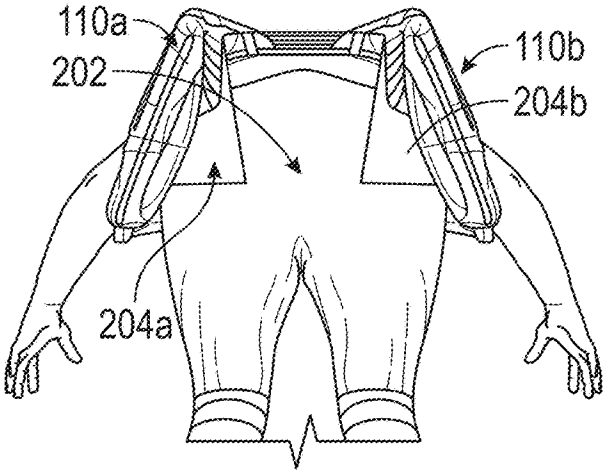
Figure 3C:
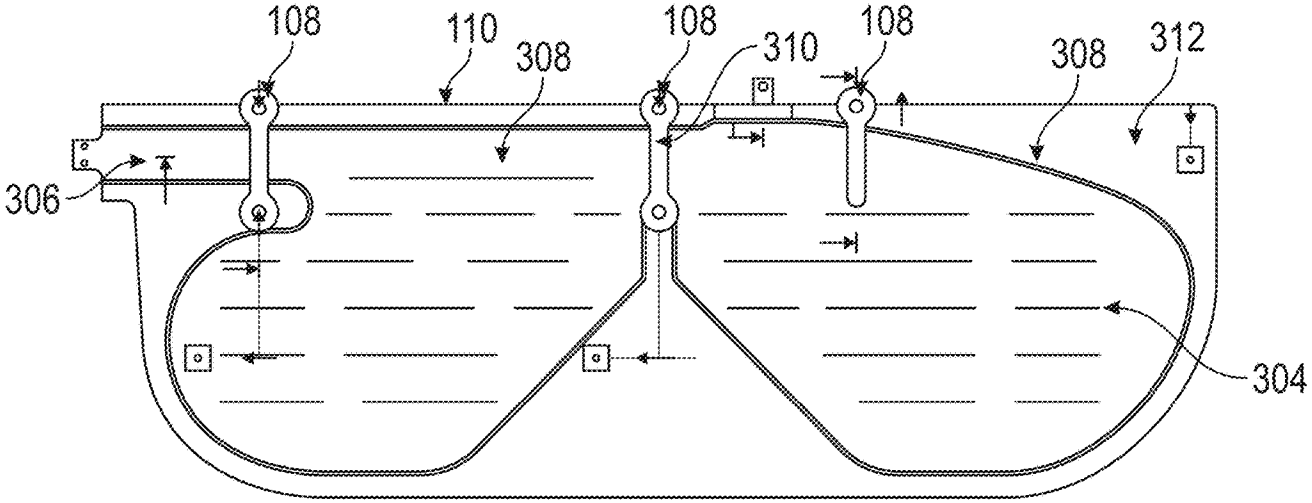

Now referring to FIGS. 3*a* to 3*c*, where a further exemplary embodiment of a wearable protection device according to the present disclosure and its application is shown.

The wearable protection device 100 in FIGS. 3*a-c* corresponds in principle to the wearable protection device 100 shown in FIG. 2. The wearable protection device 100 comprises inflatable elements 100*a*, 100*b* arranged adjacent to the body parts to be protected 204*a,b* of a wearer 202. FIG. 3*b* shows the deployed wearable protection device 100 while the wearer 202 is depicted in a seated position. It should be appreciated that the seated position is for visualization purposes only and shall not be construed as a deployment position for the wearable protection device 200. The wearable protection device 200 comprises two inflatable elements 100*a*, 100*b* arranged on a belt 102. In the front of region of the wearable protection device, two independent gas generating devices 302*a,b* are provided. Each gas generation device 302*a,b* is associated with a dedicated inlet 306 of one of the inflatable elements 110*a*, 110*b*. Upon deployment, one or both of the gas generating devices 302*a,b* may be activated so that a gas is generated for filling the respective inflatable element associated with the respective gas generating device. As can be taken from FIG. 3*a,b*, the inflatable elements 110*a*, 110*b* assume a defined three dimensional shape by bending around the body parts to be protected 204*a,b* of the wearer 202. In the exemplary embodiments of FIGS. 3*a* to *c*, the three dimensional shape substantially comprises of an inward curvature so that the inflatable elements 100*a,b* curve around the buttock region of the wearer 202 in a radial direction.

FIG. 3*c* depicts a single inflatable element 110, of which the wearable protection device 100 comprises two in a symmetrical and mirrored arrangement. The inflatable element 110 comprises an inlet 306 to which a gas generating device is connected to, so that the gas generating device, upon generation of the gas, discharges the gas into the interior of the inflatable element 110, thereby inflating the inflatable element 110. The inflatable element 110 of FIG. 3*c* comprises two inflatable regions 308, whereas one inflatable region 308 is proximal to the inlet one 306 while the second inflated region 308 is distal to inlet 306. The inflatable element 110 comprises a plurality of loop element 108 for attaching the inflatable element 110 to belt 102. In the central part of inflatable element 110, the inflatable element 110 comprises a narrow section 310 so that the inflatable regions 308 enjoy a certain freedom of movement relative to one another. E.g., one inflatable region 308 may bend more than the other inflatable region due to the anatomy of the wearer 202. Outside of the inflatable region 308, the inflatable element 110 comprises uninflatable material 312, which may be dead material 312 to be removed after manufacture, so that the dead material 312 is not present in the final wearable protection device 100. Likewise, the dead material 312 may be intended as an and inflatable region, e.g., a skirt-like material surrounding the inflatable element.

In the exemplary embodiment of FIG. 3*c*, the inflatable element 110 comprises themes 304 incorporated in the interior of the inflatable regions 308. In FIG. 3*c*, seams 304 are embodied as horizontal seams. Said seams may be provided by stitching or welding or may even be incorporated into the interior of the inflatable element, e.g., in case the inflatable element is made of one-piece woven material. In the exemplary embodiment of FIGS. 3*a-c*, the horizontal seams 304 realize the described inward bending in the radial direction with regard to the central body access of the wearer 202. In other words, horizontal seams 304 provide a good bending behaviour in the direction under the hip with a reduced bending behaviour around the hip, pointing outwards in FIG. 3*b*.

Figure 4A:
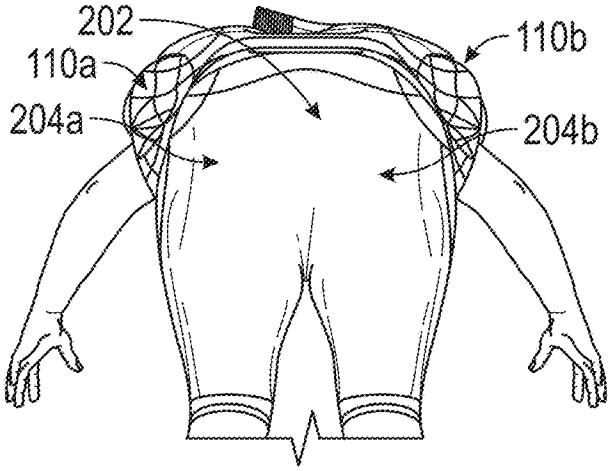
FIGS. 4*a* to 4*c* show a further exemplary embodiment of a wearable protection device according to the present disclosure and its application.
Figure 4B:
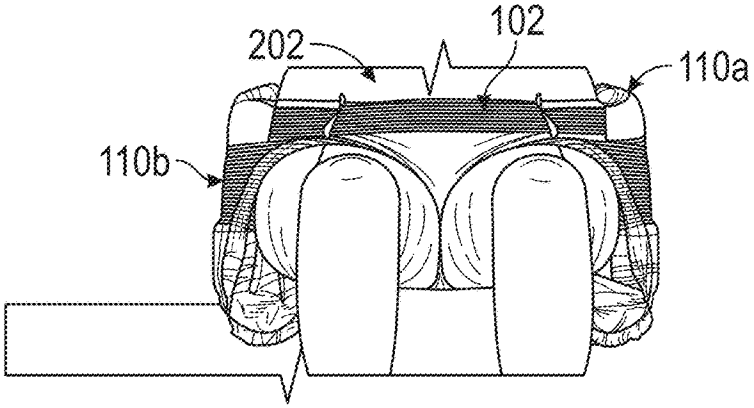
Figure 4C:
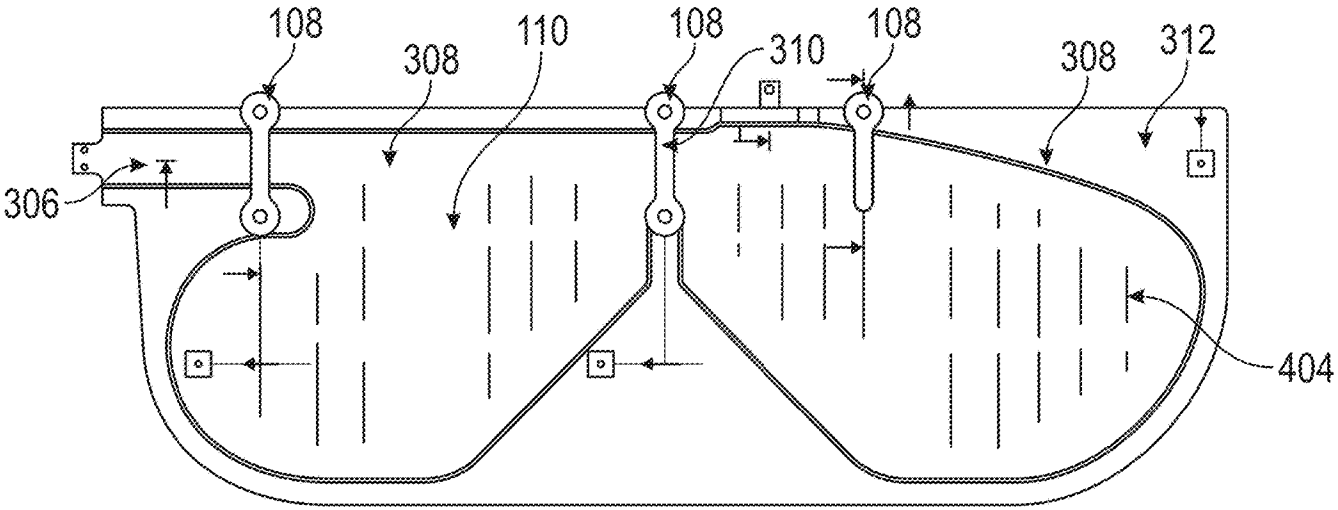

Now referring to FIGS. 4*a* to 4*c*, where a further exemplary embodiment of a wearable protection device according to the present disclosure and its application is shown.

The exemplary embodiment of FIGS. 4*a* to *c* substantially corresponds to the exemplary embodiment of FIGS. 3*a* to *c*, with the difference that the seams 404 are vertical seams 404, in other words parallel to the longitudinal body axis of the wearer 202. Providing the seams 404 in a vertical manner realizes a different bending behaviour of the inflatable element 110 with regard to the body of the wearer. Specifically, by providing vertical seams 404, the inflatable regions 308 exhibit a circumferential bending behaviour rather than a radial or inwardly (with regard to the central longitudinal body axis) bending behaviour as described with regard to the embodiment of FIGS. 3*a* to *c*. The other words, vertical seams 404 impose a bending behaviour in a circumferential direction around the central longitudinal body access of the wearer 302. In other words, vertical seams 404 provide a good bending behaviour around the hip with a reduced bending behaviour under the hip, pointing downwards in FIG. 4*b*.

Figure 5B:
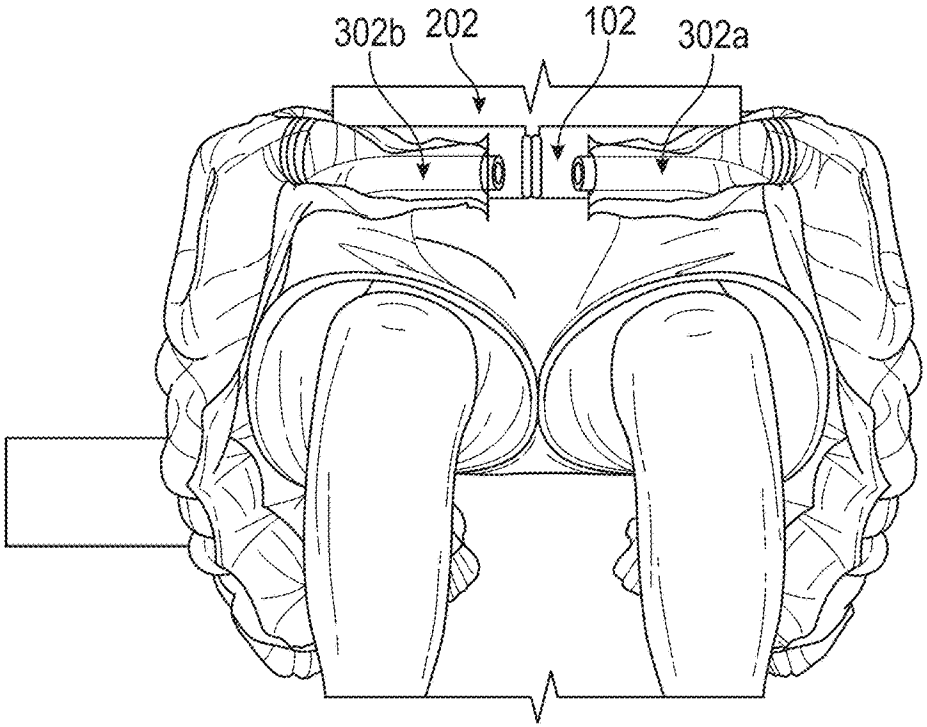
Figure 5A:
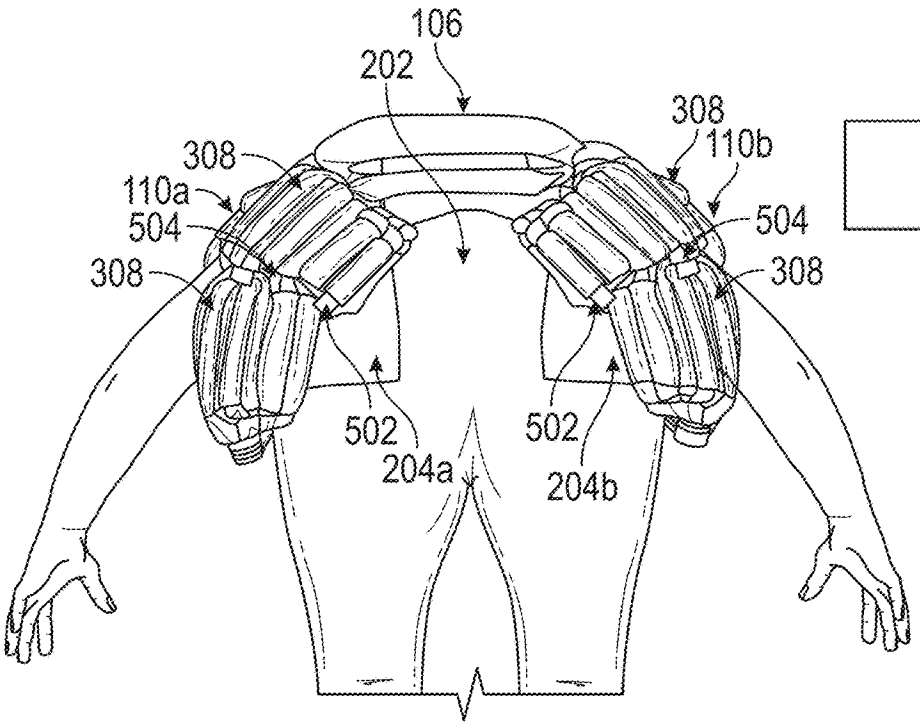

Now referring to FIGS. 5*a* to 5*c*, where a further exemplary embodiment of a wearable protection device according to the present disclosure and its application is shown.

Each of the inflatable elements 110*a*, 110*b* again comprises inflatable regions 308 which are joined together however at their distal end by a retention element 502. Between the exemplary two inflatable regions 308 of each inflatable element 110*a*, 110*b* a further retention element 504 may be provided. Element 504 may be a seam or the like, comparable to seam 24. The seams of the inflatable element 110*a*, 110*b* of FIGS. 5*a* and *b* again are horizontal seams 304. As described previously, horizontal seams exhibit a bending behaviour where the inflatable elements 110*a*, 110*b* bend inwardly towards the central body axis in the longitudinal direction (assuming that the wearable protection device 100 is worn circumferentially around the longitudinal axis of the wearer 202). By providing retention elements 502 and 504, a further three-dimensional shaping of the inflatable elements 110*a*, 110*b* can be achieved. In particular, by providing the horizontal seams 304, the inflatable elements are bending inwardly while the retention element 502 pulls the inflatable regions 308 close together at the distal end of the inflatable elements 308. At the same time, the seam 504, e.g., a flexible seam, allows the distancing of the inflatable elements 308 in the central part, between the proximal end and the distal end, so that the three-dimensional shape of the inflatable element not only is a bending in one direction but substantially realizes a bending in two directions, one in the radial direction as previously described with regard to FIGS. 3*a* to *c* and additionally a circumferential bending. In other words, by providing the retention elements 502 and 504, each inflatable element comprises a cup-like shape, thereby preferably accommodating the body parts to be protected 204*a,b*, like protruding body parts. In the exemplary example of a hip protection device according to FIGS. 5*a,b* each inflatable element bends inwardly around the buttock region of the wearer 202 and further circumferentially around the hips so to provide a preferred protection for the hip region, i.e., for the area around a protruding hip bone.

FIG. 5*b* again shows gas generating devices 302*a,b*, arranged at the front side of the wearable protection device 100 adjacent to a not depicted buckle. The respective inflatable element 110*a*, 110*b* may thus be activated simultaneously or independently from one another, depending on the fall direction and assumed impact area of the wearer 202. Alternatively, it is conceivable, to provide gas generating devices in the central portion 106, depicted in FIG. 5*a* exemplarily as a pouch worn on the back. The gas generating device or devices arranged in the central portion 106, may again allow the simultaneous or independent activation of the inflatable element 110*a*, 110*b*.

As can be seen in FIGS. 5*a,b*, the provision of inflatable elements comprising a plurality, here exemplary two, inflatable regions 308 provide an increased area of protection in that the inflatable element 110*a*, 110*b* extend further in the radial direction thus under the buttock area of the wearer 202 and further in the circumferential direction around the hip area of the wearer 202.

Figure 6A:
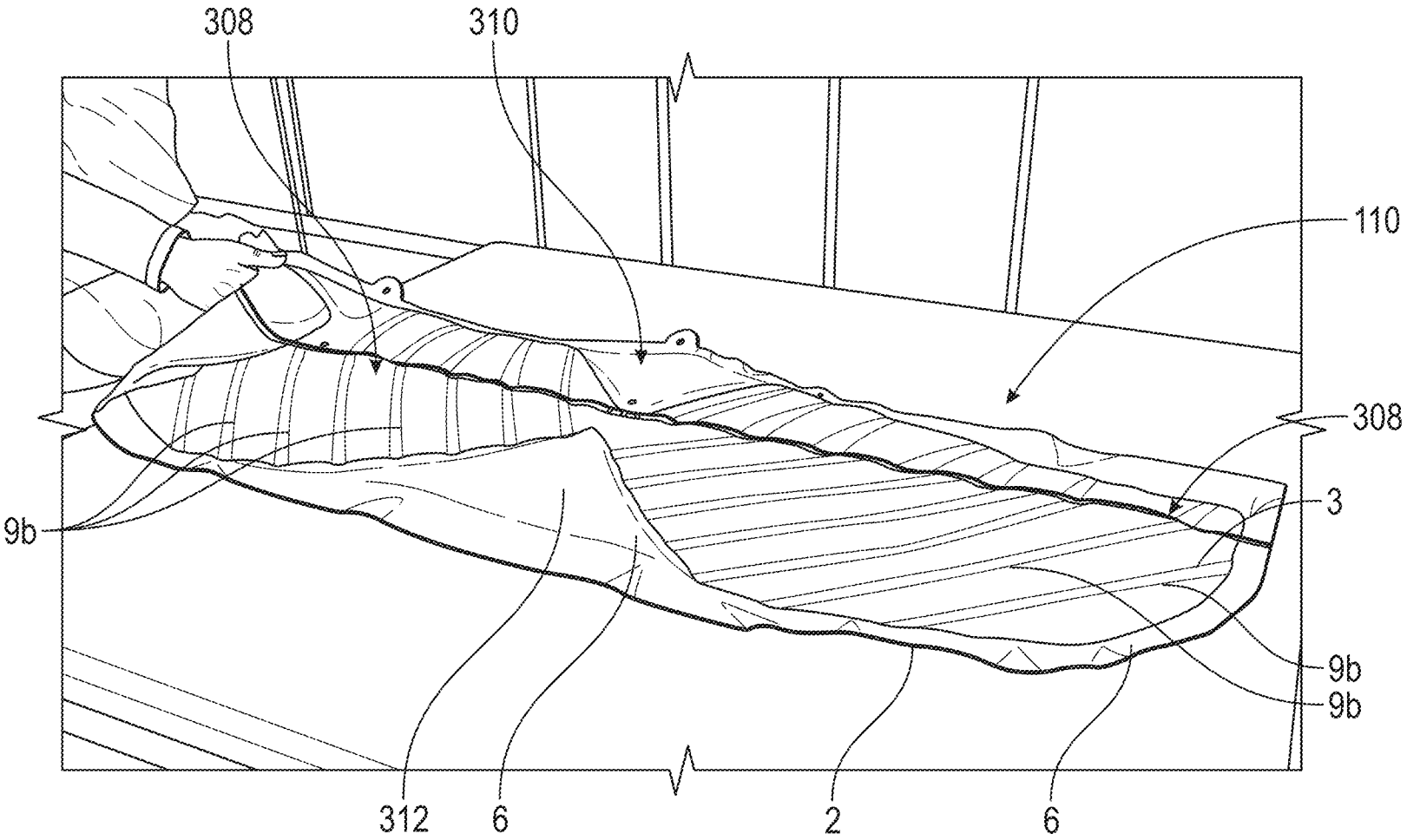
FIG. 6*a* is a perspective view of an uninflated airbag according to the present disclosure.

FIG. 6*a* illustrates inflatable element 110, in particular a one-piece woven inflatable element 110, in a pre-inflated configuration in which it is laid flat. The inflatable element 110 has a somewhat elongate configuration. The inflatable element comprises two fabric layers 2, 3, where a first fabric layer to is not specifically depicted as it is the underside of inflatable element 110 laying on the surface, whereas the second fabric layer 3 is the top layer visible in FIG. 6A. An integral peripheral seam 6 of the illustrated inflatable element 110, connecting the first and second fabric layers 2, 3, follows a circuitous path having a re-entrant region such that the resulting inflatable region 308 of the inflatable element 110 has a shape resembling a pair of spectacles, presenting two major inflatable regions 308 which are fluidly interconnected by a narrow section 310. Adjacent the re-entrant region of the peripheral seam 6, outside the inflatable region 308, the yarns of the two fabric layers 2, 3 are interwoven to define an uninflatable region of uninflatable material or dead material 312 of the inflatable element 110, in the manner of a thicker web of fabric.

The inflatable element 110 of FIG. 6*a* comprises seams 9*b* within which tether yarns are implicated in the weave of the second fabric layer 3. As will be observed, a first group of seams 9*b* is provided in a region of the fabric layer 3 defining a first inflatable region 308, and a second group of seams 9*b* is provided in a region of the fabric layer 3 defining the second inflatable region 308. Although not visible in FIG. 6*a*, first seams 9*a* within which the tether yarns are implicated in the weave of the underlying first fabric layer 2 are also provided. Like the second seams 9*b*, the seams 9*a* are similarly split into two groups-namely a first group provided in a region of the underlying first fabric layer 2 defining the first inflatable region 308, and a second group provided in a region of the underlying first fabric layer 2 defining the second inflatable region 308. The seams 9*a*, 9*b* in the first group (i.e. corresponding to the first inflatable region 308) are arranged to as to extend parallel to one another, whilst the seams 9*a*, 9*b* in the second group (i.e. corresponding to the second inflatable region 308) are also arranged to as to extend parallel to one another. However, it will be observed that the seams 9*a*, 9*b* of the first group are not parallel to the seams 9*a*, 9*b* of the second group.

Figure 6B:
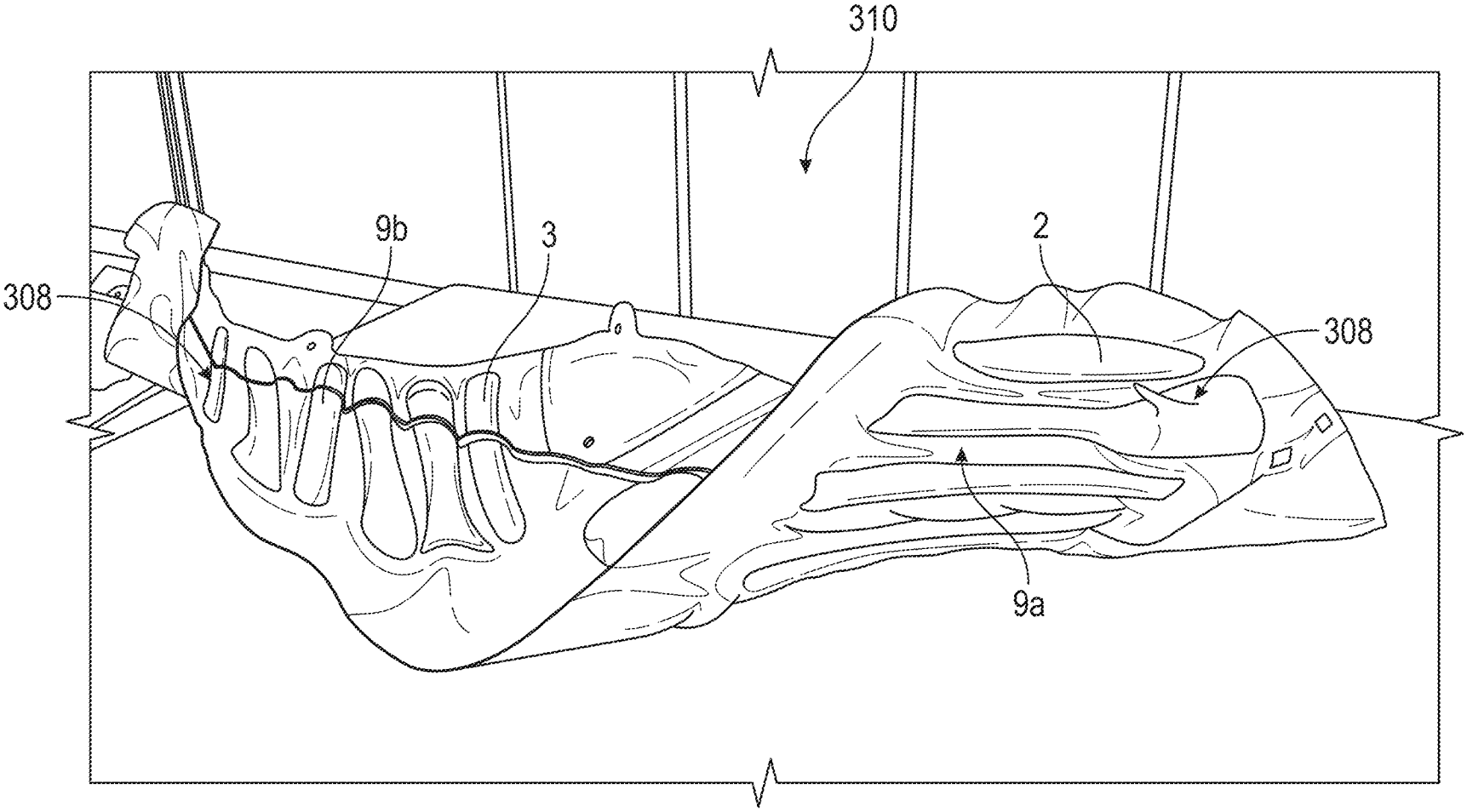
FIG. 6*b* is another perspective view of the airbag illustrated in FIG. 6*a*, but which shows the airbag in an inflated, and curved, configuration.

Turning now to consider FIG. 6*b*, the inflatable element 110 of FIG. 6*a* is illustrated in an inflated condition. As will be noted, tether yarns serve to induce a first curvature to the inflatable regions 308 of the inflatable element 110 such that they bend upwardly, considering FIG. 6*b*. Similarly, the tether yarns 8 forming the first and second connection regions 9*a*, 9*b* of the second group (i.e. corresponding to the second chamber region 7*b*) serve to induce a second curvature to the second chamber region 7*b* of the airbag 1 such that it also bends upwardly. As will be appreciated, the inflatable regions 308 are thus caused to achieve an inflated shape in which they bend about the longitudinal extension directions of the first and second group of seams 9*a*, 9*b*, respectively. As will be noted, in this arrangement each inflatable region 308 is thus configured to bend in a single, dedicated direction, with the two directions of the inflatable regions 308 being different to one another and defined by the direction of extension of the respective seams 9*a*, 9*b* across the local regions of the fabric layers 2, 3.

In some circumstances, it can therefore be desirable to provide an inflatable element 110 which can be optimised to bend in two directions rather than merely one direction.

FIG. 6*b* illustrates a short length of one-piece woven production web 21 comprising opposing first and second layers of fabric 2, 3. The production web 21 is woven via a one-piece weaving technique such that the two layers of fabric 2, 3 are woven simultaneously on a single specially-configured loom, in a manner known per se. The warp yarns of the fabric extend in a warp direction 12, and the weft yarns of the fabric extend in the weft direction 11. The short length of web 21 illustrated in FIG. 16 can be seen to comprise a pair of integrally formed inflatable elements 110, the two inflatable elements 110 being formed within the web as mirror images of one another across the longitudinal (i.e. aligned with the warp direction 12) axis 22. The inflatable elements 110 are defined by respective peripheral seams 6 within which the yarns of the two layers of fabric 2, 3 are interwoven such that each peripheral seam 6 is formed as an integral structural feature of the fabric of the respective inflatable element 110.

The peripheral seam 6 of each inflatable element 110 defines the inflatable element's 110 main inflatable area, but also an elongate inlet region for an inlet 306 which will be understood to be configured to receive or be connected to a gas generating device. In the arrangement illustrated in FIG. 6*c* it will also be observed that each inflatable element 110 has an additional integrally formed seam 24 which is substantially linear and which extends inwardly from the peripheral seam 6. As will be explained in more detail hereinafter, the additional seam 24 of each inflatable element 110 represents a flexure seam and is provided to help induce curvature to the inflatable element 110 when it is inflated. Since the seam 24 allows the adaptation of the three-dimensional shape of the inflatable elements 110, seam 24 may be understood as a retention element 502 in the context of the present disclosure.

Each of the inflatable elements 110 may be removed from the production web 21 by cutting through the fabric layers 2, 3 of the web, around the peripheral seam 6. The resulting inflatable elements 110 are illustrated after removal from the production web 21 in FIG. 6*d*, in which it will be noted that the inflatable elements 110 are shown in different orientations to FIG. 6*c*.

Figure 6C:
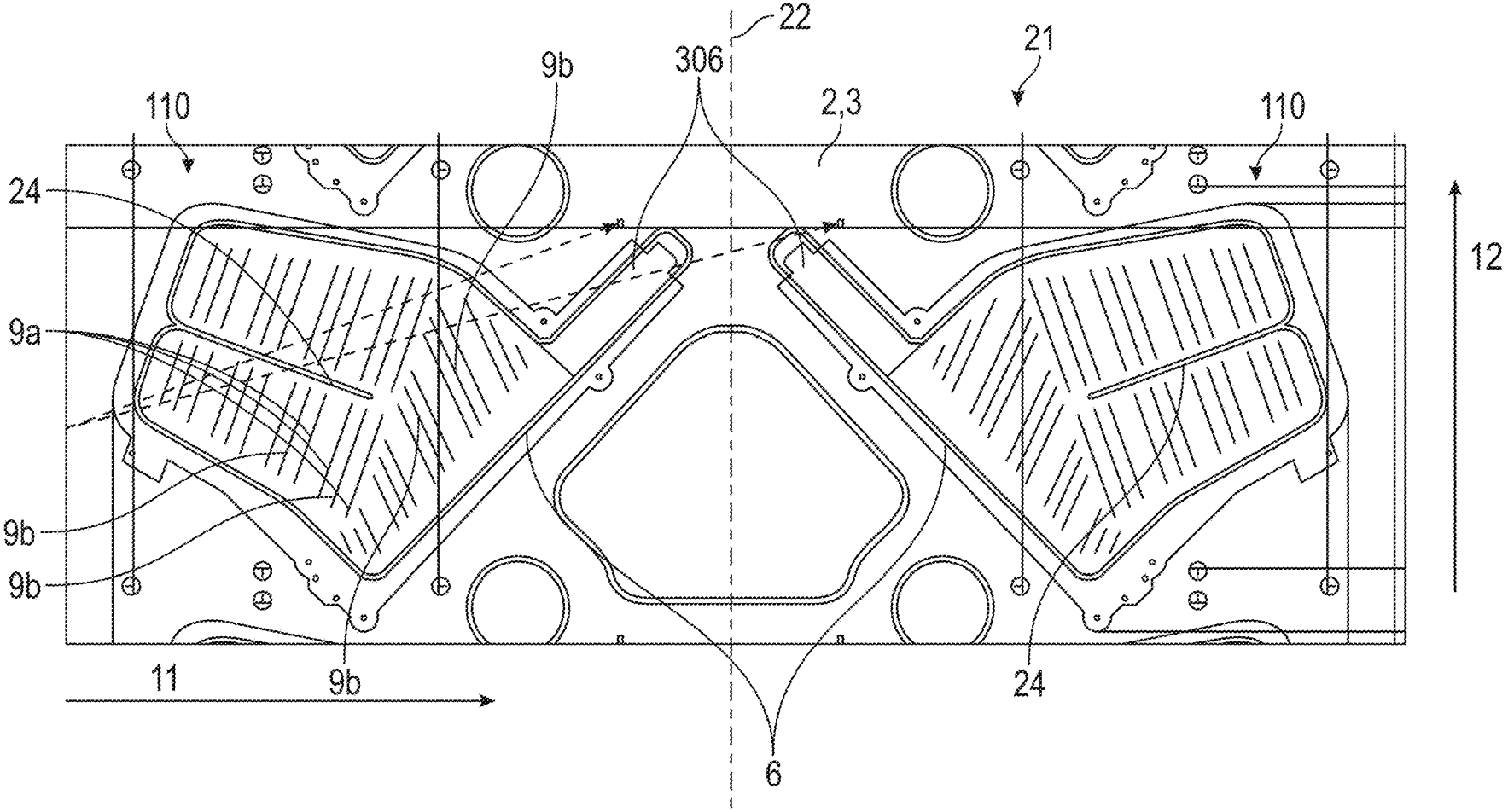
FIG. 6*c* is a schematic plan view of a one-piece woven web comprising opposing layers of woven fabric, within which are formed a pair of airbags according to the present disclosure.
Figure 6D:
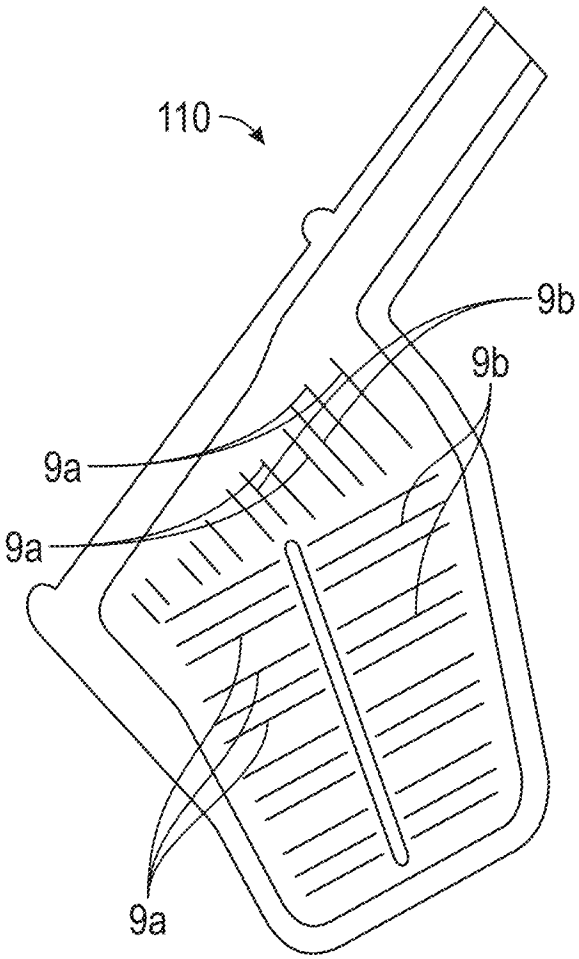
FIG. 6*d* is a plan view from above showing a pair of airbags obtained from the web illustrated in FIG. 6*c*.
Figure 6D:
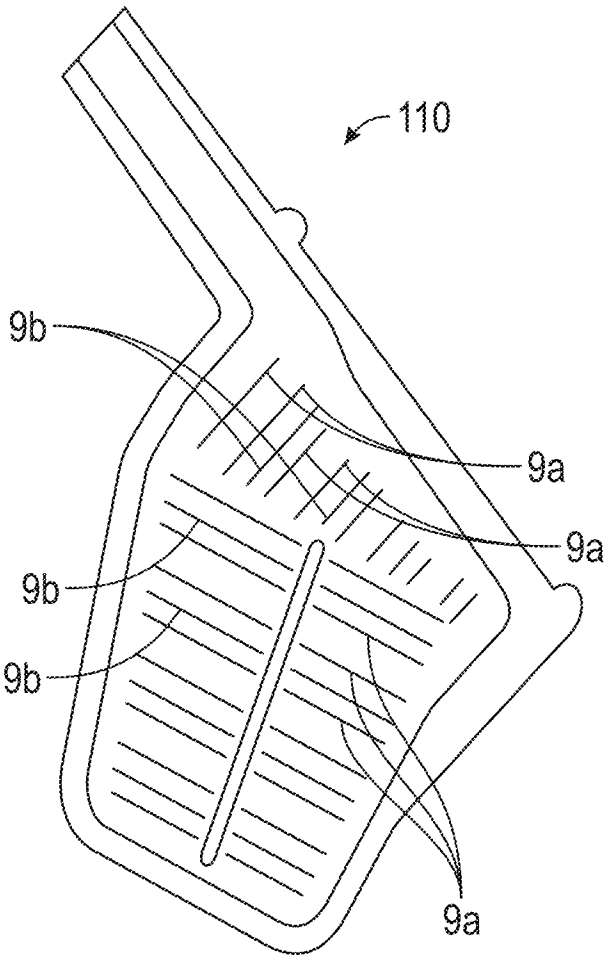

As in the previous embodiments, the inflatable elements 110 shown in FIGS. 6*c* and 6*d* are provided with internal tether arrangements, and thus comprise a plurality of tether yarns which are implicated in the weave of the first fabric layer 2 at first connection regions or seams 9*a*, and which are implicated in the weave of the second fabric layer 3 at second connection regions or seams 9*b*. The first and second connection regions or seams 9*a*, 9*b* are all elongate, and are arranged so as to extend at oblique angles to both the warp direction 12 and the weft direction 11. The connection regions or seams 9*a*, 9*b* thus extend at oblique angles to the warp yarns and the weft yarns of the fabric layers 2, 3. As will be understood from the foregoing description, the tether yarns are provided amongst the weft yarns and thus follow the weft direction 11. The tether yarns are interwoven with warp yarns of the first fabric layer 2 within the seam 9*a*, and are interwoven with warp yarns of the second fabric layer 3 within the seam 9*b*.

Figure 6E:
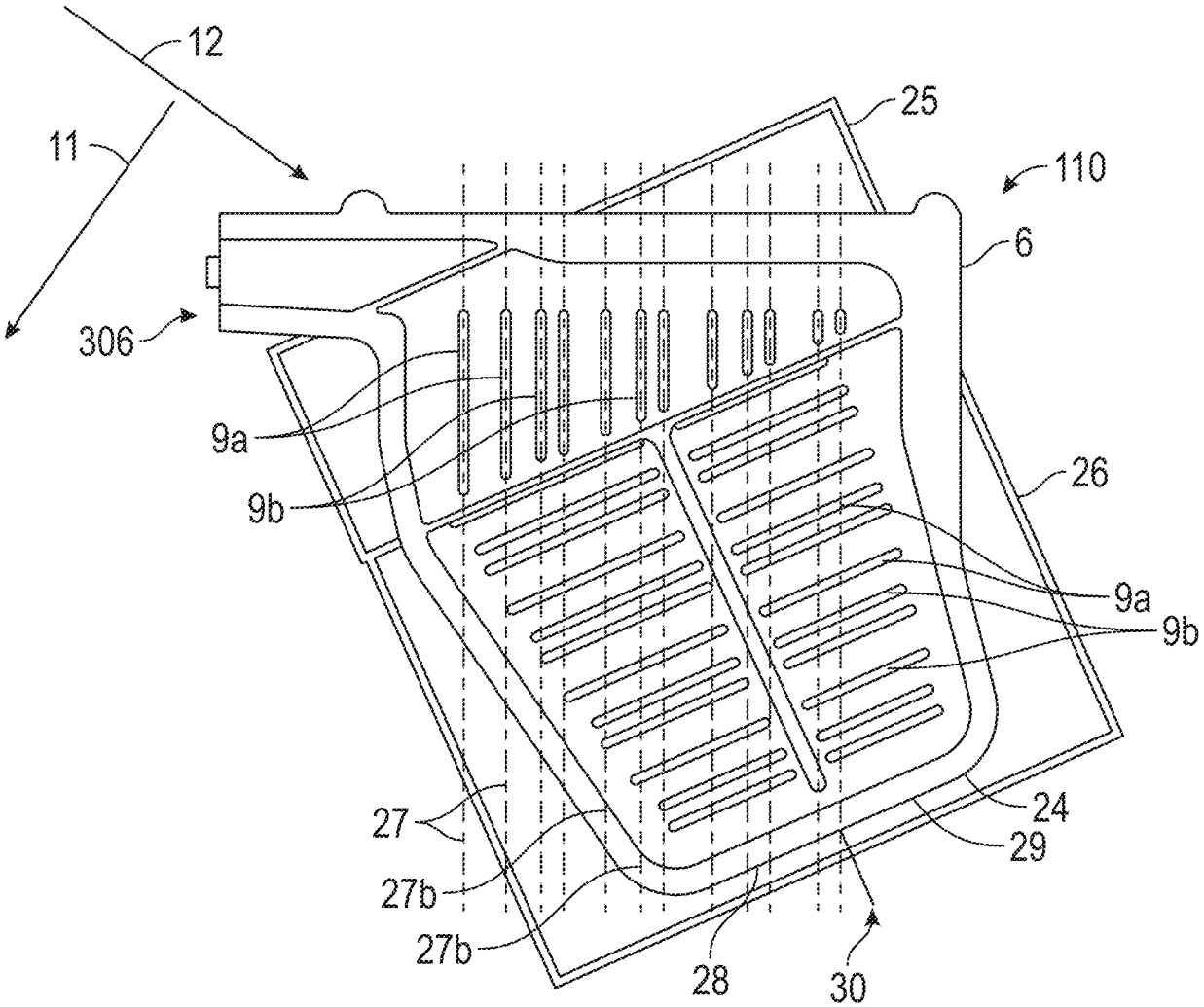
FIG. 6*e* is a schematic plan view from above showing a single one of the airbags of FIG. 6*d*.

The particular arrangement of the seams 9*a*, 9*b* in this embodiment may be most clearly understood having regard to FIG. 6*e*, in which sub-regions of the first connection regions or seams 9*a* (within which tether yarns are implicated in the weave of the first fabric layer 2) are illustrated in solid lines, and the second connection regions or seams 9*b* (within which tether yarns are implicated in the weave of the second fabric layer 3) are indicated in dashed lines.

In particular, it will be observed in FIG. 6*e* that the seams 9*a*, 9*b* are provided in two discrete groups of connection regions, namely a first group positioned within the first notional rectangular region 25, and a second (larger) group positioned within the second notional rectangular region 26. The two groups 25, 26 are located adjacent one another, and as will be appreciated, each group 25, 26 of connection regions comprises both first connection regions 9*a* (within which tether yarns are implicated in the weave of the first fabric layer 2) and second connection regions 9*b* (within which tether yarns are implicated in the weave of the second layer 3.

As will be observed, the connection regions 9*a*, 9*b* within the first group 25 are all substantially parallel to one another, whilst the connection regions 9*a*, 9*b* within the second group 26 are also substantially parallel to one another. However, the connection regions 9*a*, 9*b* of the first group 25 are non-parallel to the connection regions 9*a*, 9*b* of the second group 26. The connection regions 9*a*, 9*b* of the first group 25 thus extend at an oblique angle to the extension of the connection regions 9*a*, 9*b* of the second group 26.

A significant difference between the configuration of the inflatable elements 110 illustrated in FIGS. 6*d* to 6*e* and the previous embodiment illustrated in FIGS. 6*a* and 6*b* (which also has two discrete groups of connection regions or seams 9*a*, 9*b*) concerns the relationship between the connection regions 9*a*, 9*b* of the first group 25 and the connection regions 9*a*, 9*b* of the second group 26.

In the configuration of FIGS. 6*d* to 6*e* it will be noted that at least some of the sub-regions of the first connection regions 9*a*, and the second connection regions 9*b* of the second group 26 extend across the axes of extension 27 along which the sub-regions of the first connection regions 9*a*, and the second connection regions 9*b* of the first group 25 extend.

As will be appreciated in light of the preceding description, the tether yarns forming the first group 25 of connection regions 9*a*, 9*b* will serve induce a first curvature to the inflatable element 110 upon inflation, to bend the inflatable element 110 about the longitudinal extension direction of the first group of connection regions 9*a*, 9*b* (i.e. about the extension axes 27). As will therefore be observed, the second group 26 of connection regions 9*a*, 9*b* thus traverse the axes 27 about which the first group of connection regions will induce curvature to the inflatable element 110. This places the second group 26 of connection regions 9*a*, 9*b* within a region of the inflatable element 110 in which curvature is induced by the first group of connection regions 9*a*, 9*b*. Furthermore, the tether yarns forming the second group 26 of connection regions 9*a*, 9*b* will serve induce a second curvature to the inflatable element 110 upon inflation, to bend the inflatable element 110 about the longitudinal extension direction 27*b* of the second group of connection regions 9*a*, 9*b*. Given that the second group 26 of connection regions 9*a*, 9*b* are non-parallel to the first group 25 of connection regions 9*a*, 9*b*, it will be appreciated that the second curvature will be in a different direction or sense to the first curvature. Because the second group 26 of connection regions 9*a*, 9*b* traverse the axes 27 about which the first group 25 of connection regions 9*a*, 9*b* induce the first curvature to the inflatable element 110, the effect is therefore to induce two differently directed curvatures to the same region of the inflatable element 110, thereby effectively bending the inflatable element 110 in two different directions.

Having particular regard to the second group 26 of connection regions 9*a*, 9*b*, it will be noted from FIG. 6*e* that the second group 26 is divided into two sets of connection regions 9*a*, 9*b*, namely a first set 28 located on one side of the flexure seam 24, and a second set 29 located on the opposite side of the flexure seam 24. The flexure seam 24 thus separates the two sets 28, 29 of connection regions 9*a*, 9*b* within the second group. Furthermore, it will be noted that the seam 24 extends generally orthogonal to the extension of the connection regions 9*a*, 9*b* within the second group 26. As will also be observed, each sub-region of the first connection regions 9*a* of the first set 28 is aligned with a respective sub-region of the second set 29 so that each pair of aligned connection sub-regions 9*a*' extend collinearly. Similarly, each second connection 9*b* of the first set 28 is aligned with a respective second connection region 9*b* of the second set 29 so that each pair of aligned second connection regions 9*b* extend collinearly.

Noting that the flexure seam 24 interconnects the two layers of fabric 2, 3 of the inflatable element 110, it will be understood that the flexure seam 24 therefore serves to restrict the inflated depth of the inflatable region 308 between the two sets 28, 29 of connection regions 9*a*, 9*b* within the second group 26. In this way, the flexure seam 24 can help to permit the second group 26 of connection regions 9*a*, 9*b* to induce the second curvature to the inflatable element 110, the flexure seam 24 effectively defining a crease about which the second group 26 of connection regions 9*a*, 9*b* can then more easily bend the inflatable element 110. The words, seam 24 acts as a retention element 502, preventing the two sets 28, 29 of connection regions 9*a*, 9*b* from flaring out.

Between the first set 28 and the second set 29, the seam 24 provides a further bending axis 30, that allows that the inflated first set 28 and the inflated second set 29 also bends to some degree relative to one another. In other words, the inflatable element 110 of FIG. 6*e* allows the bending or curving of defined regions of the inflatable element 110, where the first rectangular region 25 curves around the extension direction 27 of seams 9*a,b*, whereas the second rectangular region 26 curves around the extension direction 27*b* of seams 9*a,b*, while the bending axis 30, provided by seam 24, allows a further bending of the first set 28 and the second set 29 relative to one another.

Figure 6F:
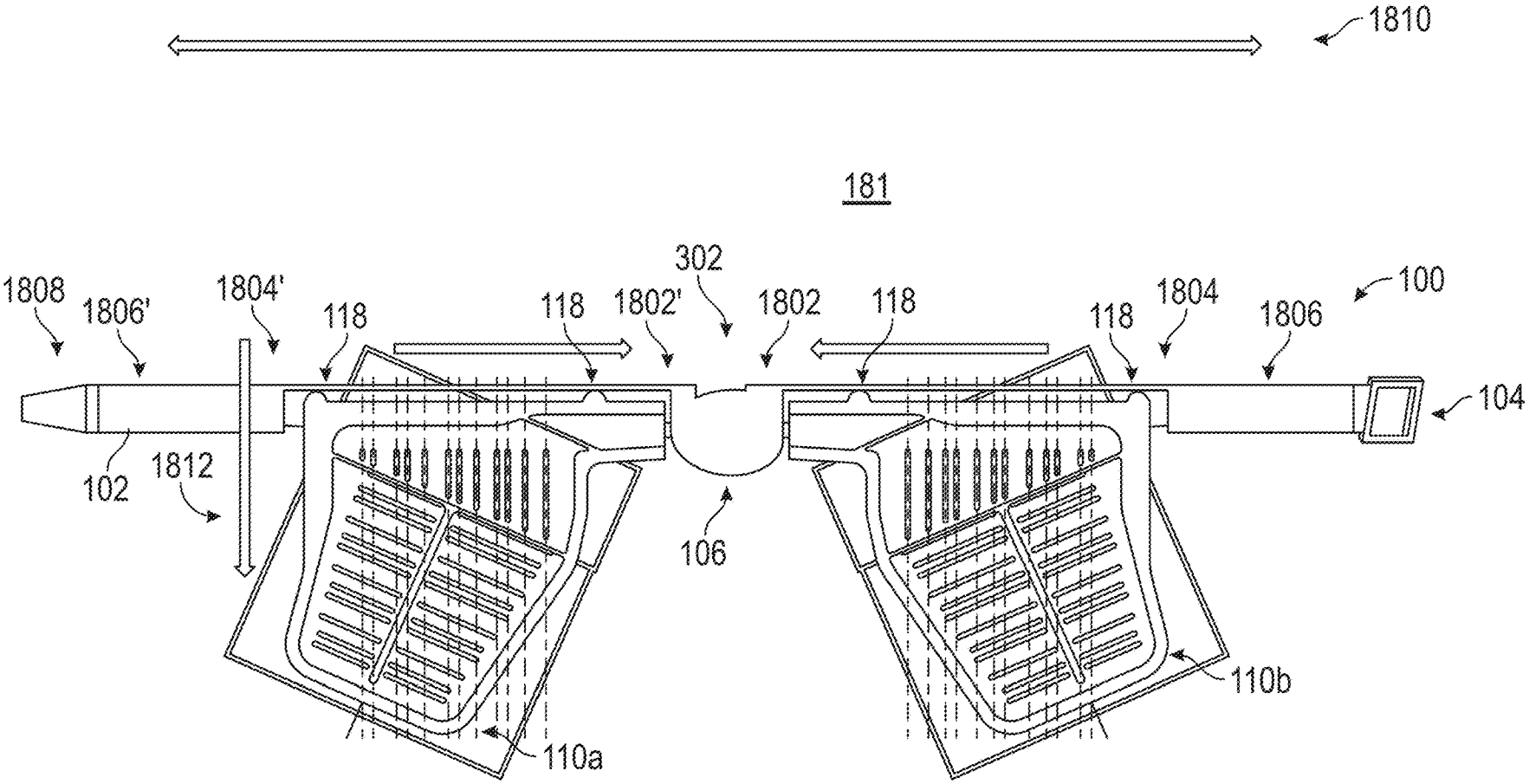
FIG. 6*f* is an exemplary embodiment of a wearable protection device according to the present disclosure.

Now referring to FIG. 6*f*, where an exemplary embodiment of a wearable protection device according to the present disclosure is shown.

FIG. 6*f* shows the symmetrical arrangement of a wearable protection device 100 according to the present invention is depicted. The inflatable elements 110*a*, 110*b* in FIG. 6*f* are depicted in the deployed condition. In the undeployed condition, the inflatable elements 110*a*, 110*b* could be arranged still as depicted in FIG. 6*f* but simply uninflated, or alternatively may be rolled up or folded, to substantially corresponds to the size or height of the attachment device 102.

Wearable protection device 100 comprises exemplarily two inflatable elements 110*a*, 110*b* arranged symmetrically but mirrored around central portion 106. The inflatable elements substantially correspond to the inflatable elements described with regards to FIGS. 6*c* to 6*e*. Alternatively, the inflatable elements 110*a*, 110*b* may be embodied according to according to one of the FIGS. 2 to 6. A gas generating device 302 is depicted schematically arranged at central position 106. The gas generating device 302 may be a single gas generating device acting on both inflatable elements 110*a*, 110*b* substantially simultaneously or may be embodied as a plurality of gas generating devices acting on the inflatable elements 110*a*, 110*b* independently. The inflatable elements 110*a*, 110*b* are arranged on an attachment device 102, exemplarily depicted as a belt. The inflatable elements 110*a*, 110*b* may be integrally formed with attachment device 102, or may be attached to attachment device 102 using loop elements 118. The attachment device 102 comprises a buckle 104 and an open end 1808, which can be connected with the buckle 104, closing the attachment device 102 around the wearer to accommodate the wearable protection device on the wearer and to arrange the inflatable elements 110*a*, 110*b* adjacent to the body part to be protected.

The inflatable elements 110*a*, 110*b* at a first end 1802, 1802' are substantially fixedly connected to the attachment device 102 while potentially loosely or slidingly connected to the attachment device 102 at a second end 1804, 1804'. The inflatable elements 110*a*, 110*b* may alternatively be also substantially fixedly connected to the attachment device 102 at the second end 1804, 1804'.

This combination of fixedly connection and sliding connection results in a lateral repositioning of the of the inflatable elements 110*a*, 110*b* in the direction of the central portion 106. In other words, when being deployed, the inflatable elements 110*a*, 110*b* inflate and increase in a first dimension and/or second dimension. Specifically, when inflating, the inflatable elements 110*a*, 110*b* may increase in thickness as a first dimension, which is in direction perpendicular to the plane of FIG. 6*f*. In case the inflatable elements 110*a*, 110*b* are rolled up or folded, the inflatable elements 110*a*, 110*b* additionally increase in a direction in the deployment direction 1812 as a second direction, as indicated by the black arrow pointing to the lower part of FIG. 6*f*. Due to the increase in size in the first dimension and/or the second dimension, the inflatable elements 110*a*, 110*b* decrease in size in a third dimension, parallel to the lengthwise extension 1810 of the attachment device 102. In other words, the inflatable elements 110*a*, 110*b* shrink in the direction 1810, and thus move closer to the central portion 106, as indicated by the two horizontal black arrows pointing inwards towards the central portion 106.

The attachment device 102 is adjustable in an adjustable region 1806 to accommodate a plurality of wearer sizes. In otherwise, the lengthwise extension 1810 of the attachment device 102 may be adjusted to e.g., the waist circumference of the wearer. A second adjustable region 1806' may be provided to allow symmetrical adjustment of the attachment device 102. Alternatively, the attachment device 102 may only be adjusted in a single adjustable region 1806, 1806'.

Figure 7A:
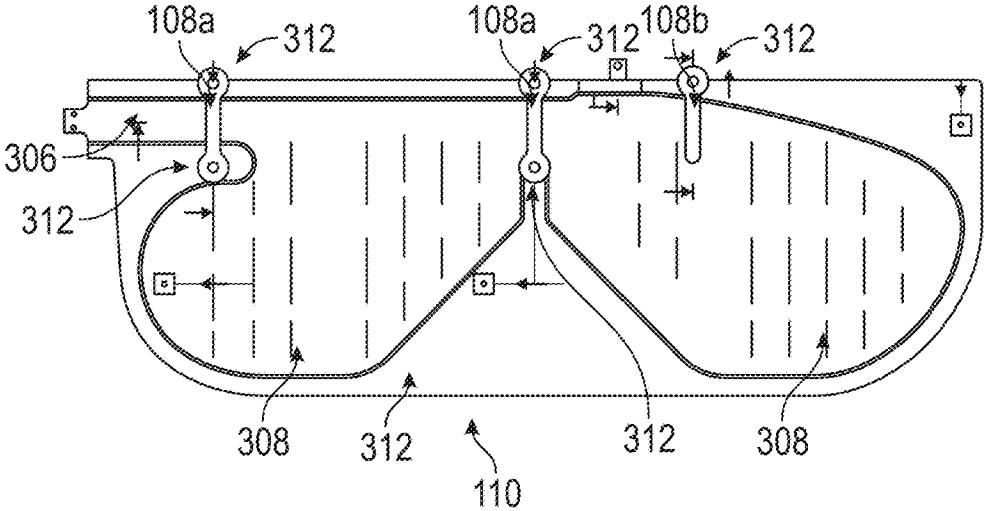
FIGS. 7*a* and 7*b* show exemplary embodiments of loop arrangements for a wearable protection device according to the present disclosure and its application.
Figure 7B:
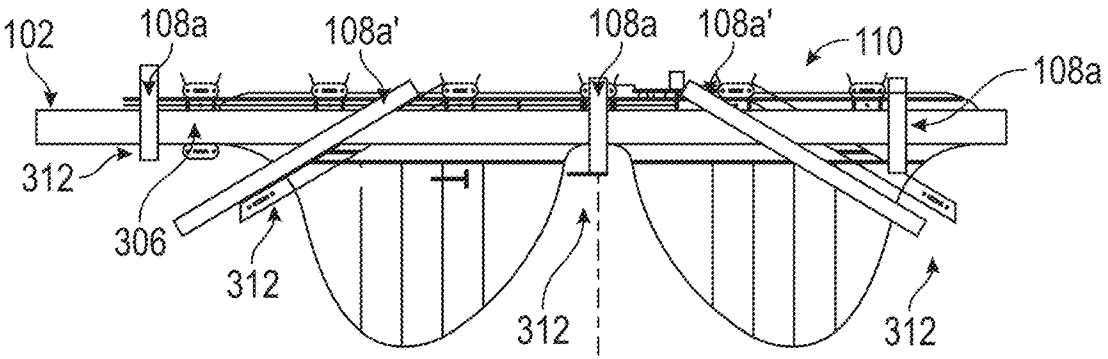

FIGS. 7*a* and 7*b* show exemplary embodiments of loop arrangements for a wearable protection device according to the present disclosure and its application.

FIG. 7*a* shows an inflatable element 110 showing a plurality of exemplary three loop elements 108*a,b*. Two loop elements 108*a* are arranged as loop elements connecting via two regions with uninflatable, dead region 312. Specifically, the loop elements 108 a connect a loop material between uninflatable region 312 at the top end of inflatable element 110 to dead region 312 through the below. The left loop element 108*a* crosses from top end of inflatable element 110 to just below the inlets 306. The central loop element 108*a* crosses again from the top end of inflatable element 110 to a central region between the two inflatable regions 308. Between the two inflatable regions 308, a narrow dead region 312 is arranged. Again, the central loop 108*a* is attached to two dead regions 312.

Contrary hereto, right loop elements 108*b* is embodied as a circular loop element attaching only at a single dead region 312 at the top end of inflatable element 110. In other words, loop element 108*b* is attached to the dead region 312 at the top end of inflatable element 110 and loops in itself until arriving again at the same dead region 312 at the top of the inflatable element 112. Loop element 108*b* made already be an integral loop element, i.e. a loop without a dedicated end or beginning, or may substantially a piece of fabric that is attached with both ends at the dead region 312, thereby forming a loop for receiving the attachment device 102. By feeding the attachment device 102 through the exemplary three loop elements 108*a,b* of FIG. 7*a*, the inflatable element 110 may be attached to the attachment device 102, which however may remain slidable within the loop elements 108*a,b*.

Now referring to FIG. 7*b*, and inflatable element 110 is shown with exemplarily five loop elements 108*a*, thus with loop elements that are attached to 2 dead regions 312. The dead regions at the top of inflatable element 110 are not depicted separately but are comparable to the dead regions 312 depicted in FIG. 7*a*. Three loop elements 108*a* are depicted substantially vertically in FIG. 7*b*, i.e., their lengthwise extension being vertical, while two loop elements 108*a*' are depicted at an angle of approximately +−60° to the vertically oriented loop elements 108*a*. In other words, the length wise extension of loop elements 108*a* and the length wise extension of loop elements 108*a*' are non-parallel. The angle of approximately +−60° is only exemplary interdependence on the specific embodiment of the inflatable element 110. In the example of FIG. 7B, when the inflatable element 110 is inflated, it is conceivable that the attachment device 102 slides along the three loop elements 108*a*, as these loop elements are arranged in areas of the inflatable element 110, that are only inflatable to a lesser extent. Further, it is conceivable that the areas where the loop elements 108*a*' are arranged at, are inflating to a larger extent. In this example, the loop elements 108*a*' provide a larger looping area to accommodate the attachment device 102. Thus, in case the inflatable element 110 inflates and thus increases in size in the area of the loop elements 108*a*', by providing a larger looping area, the risk of entanglement of the attachment device 102 and the loop elements 108*a*' is reduced.

Figure 8B:
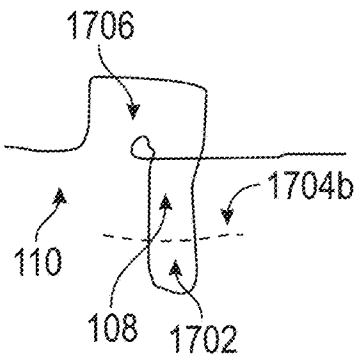
FIGS. 8*a* and 8*b* show further exemplary embodiments of loop arrangements for a wearable protection device according to the present disclosure and its application.
Figure 8A:
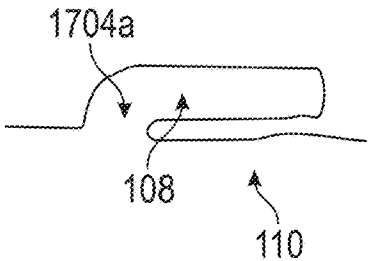

FIGS. 8*a* and 8*b* show further exemplary embodiments of loop arrangements for a wearable protection device according to the present disclosure and its application.

FIG. 8*a* shows a loop element 108 that is integrally formed with the inflatable element 110 in a first contact region 1704*a*. In other words, when manufacturing the fabric of the inflatable element 110, the loop element 108 may be manufactured as a continuous piece of fabric with inflatable element 110. Exemplarily in FIG. 8*a*, the loop element 108 is extending substantially horizontally from the contact region 1704*a*. Other directions are conceivable, e.g., the loop element 108 may be extending substantially vertically extending from the contact region 1704*a*. In FIG. 8*b*, the attachment of the loop elements 1082 the inflatable element 110 and thus the forming of the loop by forming an opening 1706 is depicted. The opening 1706 in FIG. 8*b* is only schematically and in any case shall be understood so to be able to accommodate attachment device 102. Loop element 108 is brought into contact with the fabric of inflatable element 110 in a contact region 1704*b*. The loop element 108, its fabric, may substantially be brought into contact with the fabric of the inflatable element 110, which in the contact region 1704*b* may in particular be uninflatable material, i.e., dead material or a dead region 312. In the contact region 1704*b*, the loop element 108 is attached to the inflatable element 110 by stitching or welding 1702, thereby forming the opening 1706 to accommodate the attachment device 102.

Figure 9A:
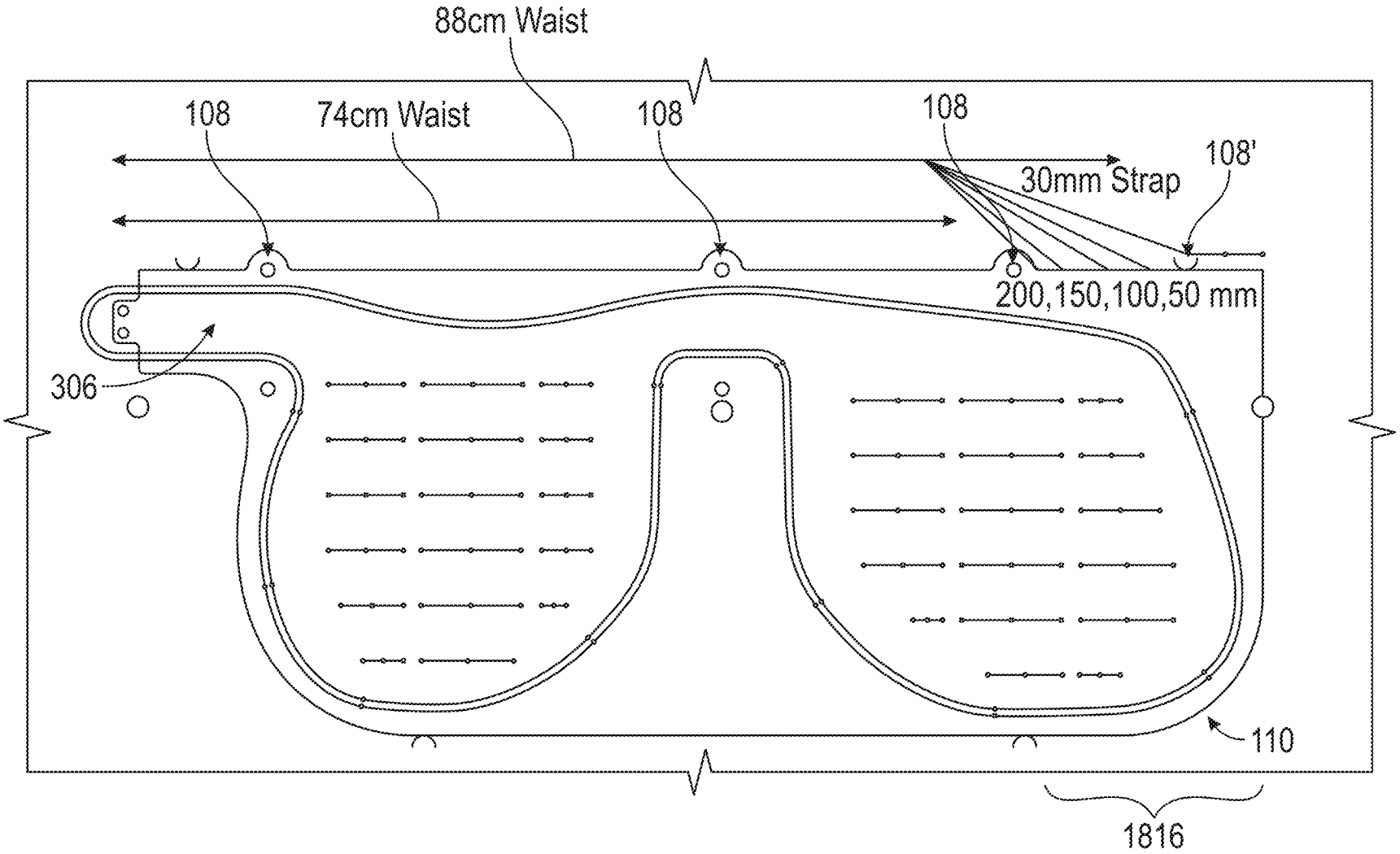
FIGS. 9*a* to 9*c* show an exemplary embodiment for sizing the wearable protection device according to the present disclosure.
Figure 9B:
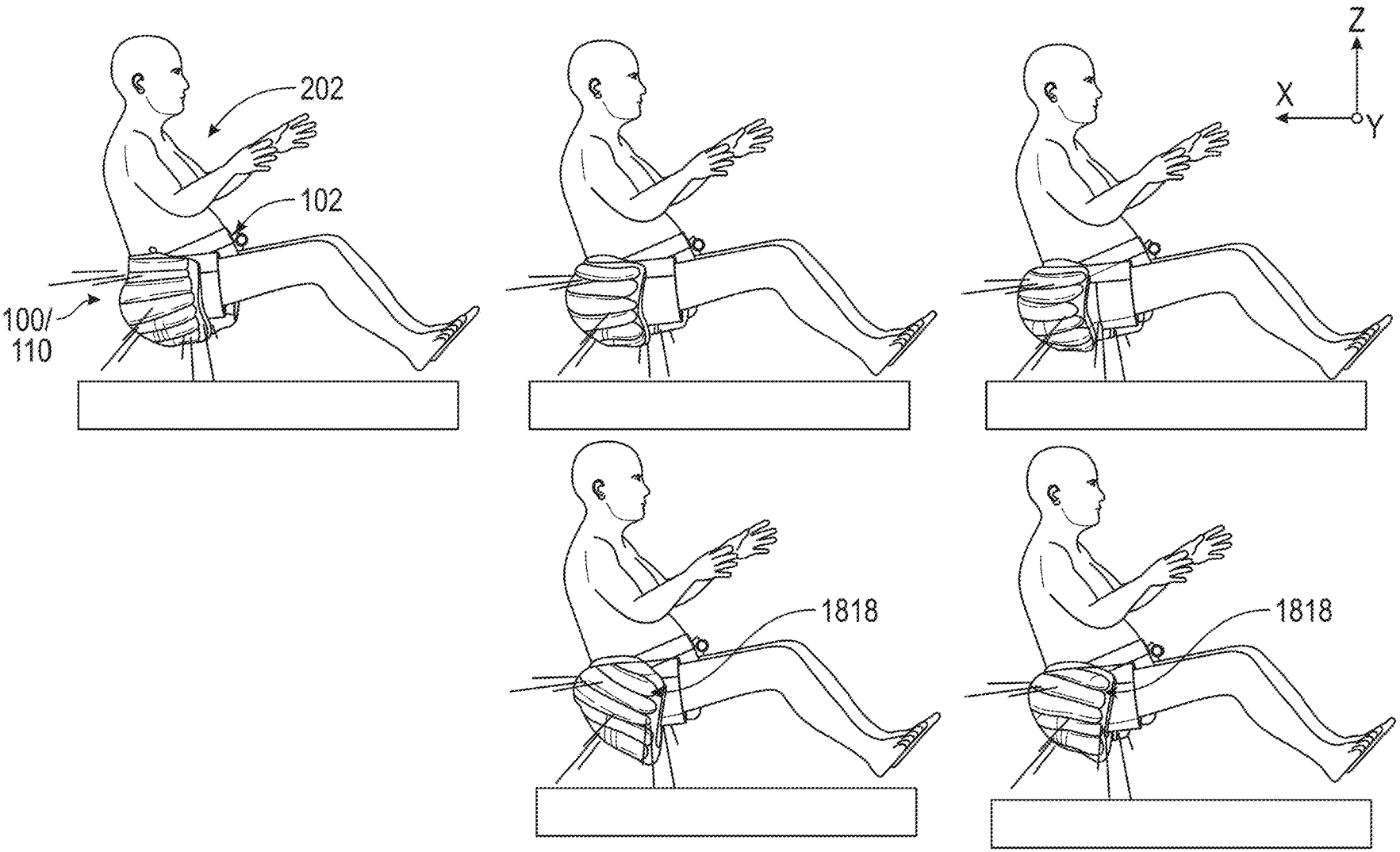
Figure 9C:
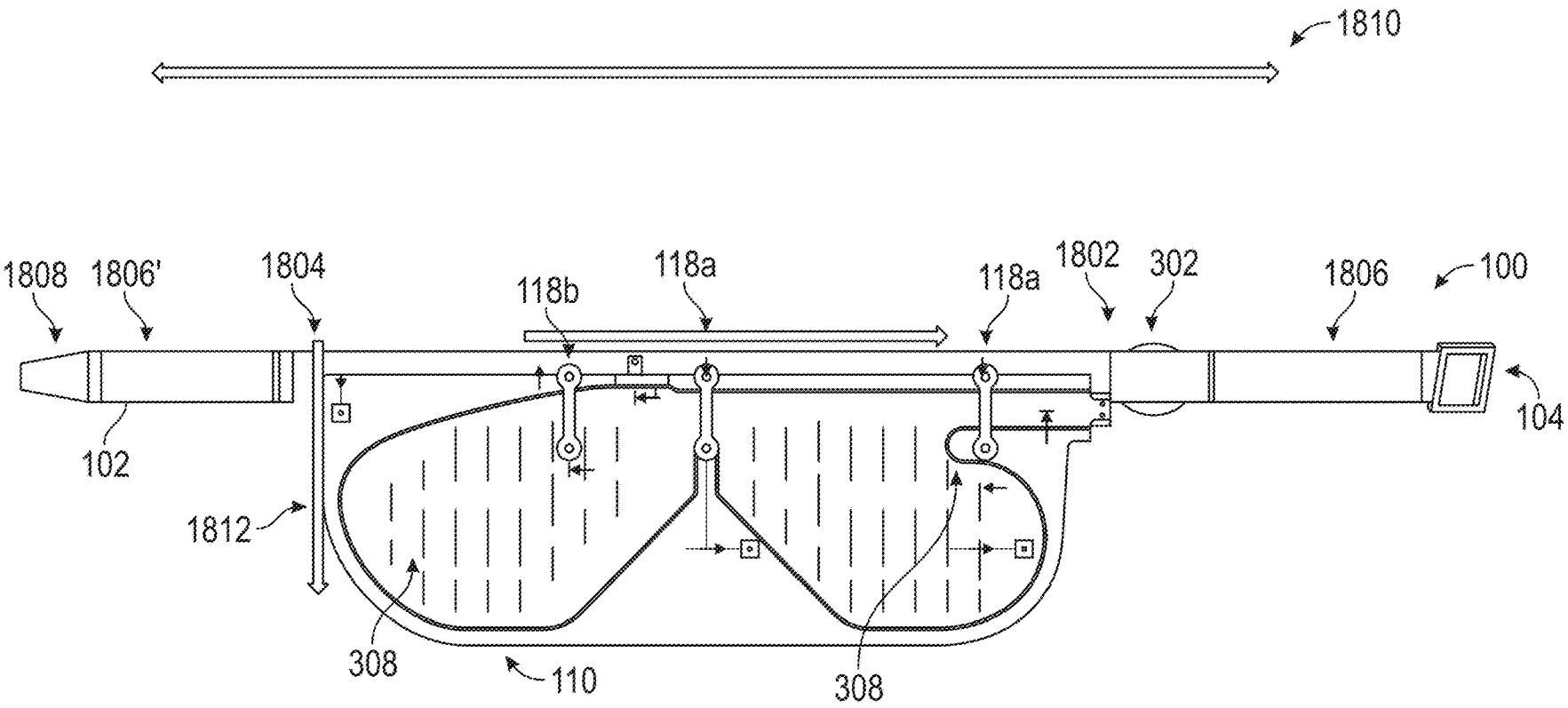

FIGS. 9*a* to 9*c* show an exemplary embodiment for sizing the wearable protection device according to the present disclosure.

FIG. 9*a* shows a representation of an inflatable element 110. The inflatable element 110 comprises exemplarily for attachment regions for loop elements 108. The three loop elements closest to inlet 106 substantially corresponds to the three loop elements depicted in FIG. 7*a*. As indicated in FIG. 9*a*, said three loop elements are intended for a first body dimension, here a waist circumference. Exemplarily, said three loop elements are intended for a waist circumference of 74 cm. A further, rightmost loop element 108' is provided, which is intended to be used in case of a second body dimension, which is larger than the first body dimension. Exemplarily, the inflatable element 110 when using the loop element 108' is intended for a waist circumference of 88 cm.

In other words, the same inflatable element 110 of FIG. 9*a* may be used for different wearer sizes. A comparably small wearer, requiring the waist circumference of 74 cm, may attach the inflatable element 110/the wearable protection device 100 only using the three left most loop elements 108, while a comparably large wearer, requiring the waist circumference of 88 cm may attach the inflatable element 110/the wearable protection device using the two left most loop elements 108 and the right most loop element 108' or alternatively all for loop elements depicted in FIG. 9*a*.

In case of an attachment using only the loop elements 108, the remaining right end 1816 of the inflatable element 110 may simply be not be attached to the wearer/the attachment device 102. In a folded or rolled up condition of the inflatable element, i.e. in the uninflated condition before deployment, the right end 1816 may first simply extend outside of the attachment device 102. Since a gas generating device intended to be used with the inflatable element 110 comprises gas for inflation of the complete inflatable element 110, the extending end 1816 does not pose a specific problem, but may simply extend from the body of the wearer in the inflated condition. Since the remainder of the inflatable element 110 is sufficient to protect a small wearer, the extended end 1816 is not required for protection of the body part to be protected.

In FIG. 9*b*, the wearable protection device 100 is shown with a single inflatable element 110, on the right side of the body of the wearer. It is of course conceivable, that the wearable protection device comprises two inflatable element 110, thus asymmetrical arrangements to provide both sides of the hip, whereas the left inflatable element 110 is arranged not visible and behind the wearer 101.

The three top representations of FIG. 9*b* show a wearer with an increasing waist circumference while the inflatable element 110 remains of identical size. In other words, the size of the attachment device 102 increases to accommodate the waist circumference of the wearer. This results in the wearable protection device 100 appearing to be situated further to the rear of the wearer 202. Since the body part to be protected, the hip region remains at the back side of the wearer, the increase in waist circumference does not impact negatively the protective function of the wearable protection device. An adjustable attachment device 102 thus compensates for the difference in waist circumference of the wearer 202 while remaining arranged adjacent to the body part be protected. The two lower representations of FIG. 9*b* show an embodiment where the wearable protection device 100, its inflatable elements 110 are of a larger size then compared to the three top representations of FIG. 9*b*. As can be seen, the protective function remains substantially unchanged while the inflatable elements 110 are extending further to the front of the wearer 202. The then inflatable element 110 of the two lower representations of FIG. 9*b* can be seen as being arranged with only the three left most loop elements 118 of FIG. 9*a*, since the right side 1818 of inflatable element 110 is depicted as not being attached to the attachment device 102 but rather pointing outwardly. Still, the protective function of the wearable protection device is not negatively impacted by this arrangement.

Now referring to FIG. 9*c*, where a first arrangement of a wearable protection device 100 according to the present invention is depicted. The inflatable element 110 in FIG. 9*c* are depicted in the deployed condition. In the undeployed condition, the inflatable element 110 may be arranged still as depicted in FIG. 9*c* but simply uninflated, or alternatively may be rolled up or folded, to substantially corresponds to the size or height of the attachment device 102.

Wearable protection device 100 comprises exemplarily a single inflatable element 110. A gas generating device 302 is depicted schematically arranged at central position 106. The gas generating device 302 may be a single gas generating device 302 acting on the inflatable element 110. The gas generating device 302 is exemplarily arrange towards the buckle 104. The inflatable element 110 is arranged on an attachment device 102, exemplarily depicted as a belt. The inflatable element 110 may be integrally formed with attachment device 102, or may be attached to attachment device 102 using loop elements 118*a,b*. The attachment device 102 comprises a buckle 104 and an open end 1808, which can be connected with the buckle 104 closing the attachment device 102 around the wearer to accommodate the wearable protection device on the wearer and to arrange the inflatable element 110 adjacent to the body part to be protected, here e.g., the buttock and hip region.

The inflatable element 110 at a first end 1802 is substantially fixedly connected to the attachment device 102 while substantially loosely or slidingly connected to the attachment device 102 at a second end 1804. This combination of fixedly connection and sliding connection results in a lateral repositioning of the of the inflatable element 110 in the direction of the gas generating device 302. In other words, when being deployed, the inflatable element 110 inflate and increase in a first dimension and/or second dimension. Specifically, when inflating, the inflatable element 110 increases in thickness as a first dimension, which is in direction perpendicular to the plane of FIG. 9*b*. In case the inflatable element 110 are rolled up or folded, the inflatable element 110 additionally increases in a direction in the deployment direction 1812 as a second direction, as indicated by the black arrow pointing to the lower part of FIG. 9*c*. Due to the increase in size in the first dimension and/or the second dimension, the inflatable element 110 decrease in size in a third dimension, here exemplarily parallel to the lengthwise extension 1810 of the attachment element 102. In other words, the inflatable element 110 shrinks in the direction 1810, and thus moves closer to the gas generating device 302, as indicated by the central horizontal black arrow pointing inwards towards gas generating device 302. In order to provide sufficient protection in the inflated second condition, one inflatable region, here, e.g., the left inflatable region 308 of FIG. 9*c*, may be larger than the other inflatable region, here, e.g., the right inflatable region 308 of FIG. 9*c*.

The attachment device 102 is adjustable in an adjustable region 1806 to accommodate a plurality of wearer sizes. In other words, the lengthwise extension of the attachment device 1810 may be adjusted to e.g., the waist circumference of the wearer. A second adjustable region 1806' may be provided to allow symmetrical adjustment of the attachment device 102. Alternatively, the attachment device 102 may only be adjusted in a single adjustable region 1806, 1806'.

Figure 10B:
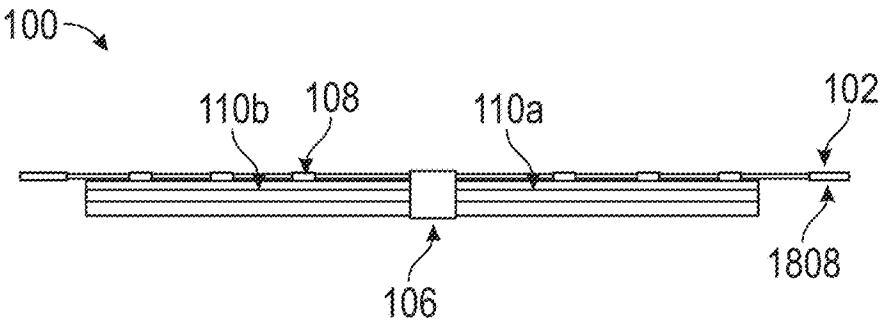
FIGS. 10*a* to 10*c* show an exemplary embodiment of a wearable protection device according to the present disclosure and its application in an uninflated state.
Figure 10C:
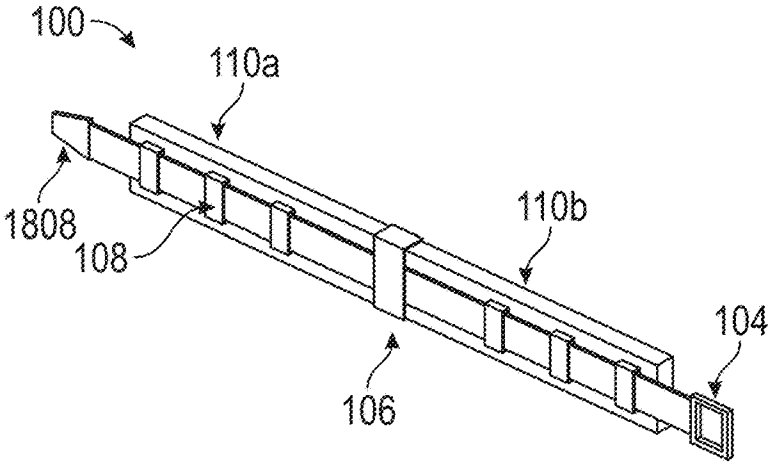
Figure 10A:
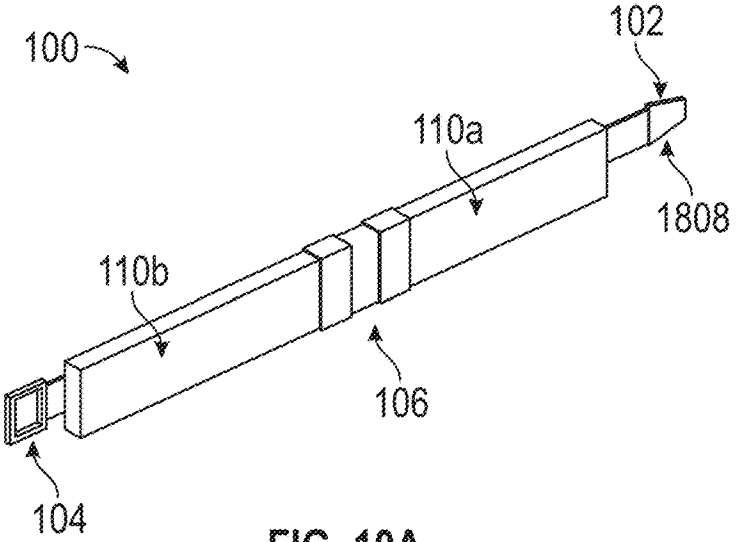

FIGS. 10*a* to 10*c* show an exemplary embodiment of a wearable protection device according to the present disclosure and its application in an uninflated state.

FIGS. 10*a* to 10*c* show the wearable protection device 100 as depicted in FIG. 1 from different angles. FIG. 10*a* shows the outer surface of the wearable protection device 100 from an outside and elevated position. FIG. 10*b* shows the wearable protection device 100 from directly above and in an open position. A wearer wearing the wearable protection device 100 and looking downward would see the wearable protection device 100 substantially as depicted in FIG. 10*b*. FIG. 10*c* shows the inside of the wearable protection device 100, against from an elevated position. As can be seen, the wearable protection device 100 is attached to a belt 102 with exemplarily six loop elements 108 around a central portion 106, possibly comprising a loop around the belt 102 as well as the wearable protection device 100. Not specifically depicted are gas generating devices, which may be accommodated in the central portion 106. The belt 102 comprises a buckle 104 as well as an open end 1808, which in turn may be fed through the buckle 104 for fastening the belt 102.

The belt 102 may be attached to the hip region of a wearer and by closing the belt 102, i.e., feeding the belt 102 through the buckle 104 and fastening the buckle 104, the size of the wearable protection device 100 around the waist of the wearer may be adjusted by appropriate positioning of the open and 1808 and buckle 104 so to allow comfortable wearing of the wearable protection device 100. The wearable protection device 100 comprises two inflatable elements 110*a*, 110*b*, arranged around a central portion 106 of the wearable protection device 100. In other words, the inflatable elements 110*a*, 110*b* are arranged symmetrically with regard to the central portion 106. The belt 102 may be integrally formed with the wearable protection device 100 or, as depicted in FIG. 6*a* to *c*, may be a separate element from belt 102.

It is to be understood that the invention is not limited to the embodiments described above, and various modifications and improvements may be made without deviating from the concepts described here. Any of the features described above and below may be used separately or in combination with any other features described herein, provided they are not mutually exclusive, and the disclosure extends to and includes all combinations and sub-combinations of one or more features described herein.

Finally, it should be noted that the term "comprising" not exclude other elements or steps, and that "a" or "one" does not exclude the plural. Elements that are described in relation to different types of embodiments can be combined. Reference signs in the claims shall not be construed as limiting the scope of a claim.

LIST OF REFERENCE NUMERALS

2 first fabric layer
3 second fabric layer
6 peripheral seam, integral
7*a* chamber region
9*a,b* seam
11 weft direction
12 warp direction
21 production web, one piece woven
22 axis
24 seam, integrally formed
25 first rectangular region
26 second rectangular region
27,*a* extension axis
28 first set
29 second set
30 bending axis
100 wearable protection device
102 attachment device/belt
104 buckle
106 central portion
108,*a,b,a'* loop element
110,*a,b* inflatable elements
202 wearer
204,*a,b* body part to be protected
206 object
302,*a,b* gas generating device
304 horizontal seam
306 inlet
308 inflatable regions
310 narrow section
312 uninflatable material, dead material, dead region
404 vertical seam
502 retention element
504 opening
1702 stitching/weld
1704*a,b* contact regions
1706 opening
1802,' first end
1804,' second end
1806,' adjustable region
1808 open end
1810 lengthwise extension of attachment device
1812 deployment direction perpendicular to lengthwise extension of attachment device
1814 longitudinal axis of the wearer
1816 right end
1818 right side of inflatable element

The invention claimed is:

1. A wearable protection device for protection of at least a body part of a wearer, comprising an inflatable element configured to be arranged adjacent to a body part to be protected, wherein the inflatable element is inflatable from a first, uninflated condition to a second, inflated condition, by application of a releasable source of a gas to the inflatable element, for at least partially filling of the inflatable element with said gas, wherein the inflatable element, when being inflated to the second inflated condition, assumes a predetermined three-dimensional shape, wherein the inflatable element comprises a first extension in a first direction and a second extension in a second direction, wherein the first direction and the second directions are non-parallel to one another, wherein one of the first extension and the second extension in the first condition is larger than in the second condition, and wherein the other one of the first extension and the second extension in the first condition is smaller than in the second condition, so that when transitioning from the first condition to the second condition, the inflatable element increases in dimension in one extension while the inflatable element decreases in dimension in the other extension, wherein the wearable protection device is reversibly connected to an attachment device for attaching the wearable protection device to the wearer, wherein the wearable protection device is adapted to be at least partially slidable relative to the attachment device, so that when one of the first extension and the second extension becomes smaller while inflating the inflatable element, the wearable protection device is configured to slide along the attachment device while maintaining being connected to the attachment device and being configured to be arranged adjacent to the body part to be protected; and wherein the wearable protection device is connected to the attachment device by a plurality of loop elements, wherein the loop elements are adapted for accommodating the attachment device and are arranged for sliding along a length of the attachment device.

2. The wearable protection device according to claim 1, wherein the inflatable element and at least one loop element of the plurality of loop elements are integrally formed, thereby forming an opening for accommodating the attachment device, in particularly wherein the inflatable element and at least one loop element of the plurality of loop elements are integrally formed of a one-piece woven fabric.

3. The wearable protection device according to claim 1, wherein the inflatable element and at least one of the plurality of loop elements are in contact at two contact regions, wherein the inflatable element and the at least one of the plurality of loop elements are integrally formed at a first contact region of the two contact regions, and wherein the inflatable element and the at least one of the plurality of loop elements are connected but not integrally formed at a second contact region of the two contact regions, thereby forming an opening for accommodating the attachment device.

4. The wearable protection device according to claim 1, wherein the inflatable element comprises inflatable regions and uninflatable regions, and wherein at least one of the plurality of loop elements is attached to two uninflatable regions of the inflatable element, thereby forming an opening for accommodating the attachment device.

5. The wearable protection device according to claim 4, wherein the inflatable element comprises a one-piece woven fabric and wherein the uninflatable regions are regions where the one-piece woven fabric is integrally woven.

6. The wearable protection device according to claim 1, wherein the loop elements comprise a lengthwise extension, and wherein the lengthwise extension of a first subset of loop elements and the lengthwise extension of a second subset of loop elements are non-parallel.

7. The wearable protection device according to claim 1, wherein the inflatable element at a first end remains fixed relative to the attachment device, when the inflatable element slides relative to the attachment device when being inflated, while the wearable protection device at a second end opposite of the first end slides relative to the attachment device and towards the first end, wherein the wearable protection device is shortened in length when being inflated, and wherein the inflatable element is asymmetrical with regard to a point arranged centrally between the first end and the second end, in particular wherein the part of the inflatable element between the second end and the centrally arranged point is larger than the part of the inflatable element between the first end and the centrally arranged point.

8. The wearable protection device according to claim 1, wherein the attachment device is adjustable so to accommodate a plurality of wearer sizes, in particular wherein adjusting the size of the attachment device does not change the alignment of the wearable protection device relative to the attachment device.

9. The wearable protection device according to claim 1, wherein the attachment device is a belt.

10. The wearable protection device according to claim 1, wherein the inflatable element comprises a one-piece woven fabric with woven in tethers for providing the defined three-dimensional shape when in the inflated condition.

11. The wearable protection device according to claim 1, wherein the defined three-dimensional shape is adapted to the body part to be protected.

12. The wearable protection device according to claim 1, wherein the wearable protection device comprises at least two inflatable elements configured to be arranged symmetrically to a body axis of the wearer, in particularly symmetrical with regard to the longitudinal axis of the wearer.

13. The wearable protection device according to claim 1, wherein the wearable protection device is a hip protection device, in particular configured to be worn around the waist of the wearer and attached to a belt configured to be worn by the wearer by the loop elements and configured to protect the body part in the event of a fall incident.

14. The wearable protection device according to claim 1, wherein the wearable protection device, when being inflated, deploys in a direction perpendicular to the lengthwise extension of the attachment device, in particular deploying around the body of the wearer so to accommodate the body part to be protected in the inflatable element for mitigating a fall impact.

* * * * *